US010994403B2

(12) United States Patent
Bantle et al.

(10) Patent No.: US 10,994,403 B2
(45) **Date of Patent: *May 4, 2021**

(54) HAND-HELD POWER TOOL COMPRISING A GEARSHIFT UNIT

(71) Applicant: Robert Bosch GmbH, Stuttgart (DE)

(72) Inventors: Florian Bantle, Westerheim (DE); Thomas Duerr, Asperg (DE); Juergen Gairing, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 373 days.

This patent is subject to a terminal disclaimer.

(21) Appl. No.: 16/062,715

(22) PCT Filed: Dec. 7, 2016

(86) PCT No.: PCT/EP2016/080132

§ 371 (c)(1),
(2) Date: Jun. 15, 2018

(87) PCT Pub. No.: WO2017/102516

PCT Pub. Date: Jun. 22, 2017

(65) Prior Publication Data

US 2018/0370011 A1 Dec. 27, 2018

(30) Foreign Application Priority Data

Dec. 18, 2015 (DE) ..... 10 2015 226 088.7

(51) Int. Cl.
*B25F 5/00* (2006.01)
*B25D 16/00* (2006.01)
*B25B 21/00* (2006.01)

(52) U.S. Cl.
CPC ..... *B25F 5/001* (2013.01); *B25B 21/008* (2013.01); *B25D 16/006* (2013.01); *B25D 2250/005* (2013.01)

(58) Field of Classification Search
CPC ..... B25F 5/00; B25F 5/001; B25D 16/006; B25D 250/005; B25D 250/041; G05B 2219/45127; H02K 11/35
See application file for complete search history.

(56) References Cited

U.S. PATENT DOCUMENTS 5,090,485 A 2/1992 Pomonik
9,088,239 B2 * 7/2015 Kaizo ..... H02P 29/40
(Continued)

FOREIGN PATENT DOCUMENTS

DE 10 2011 004 495 A1 8/2012
DE 10 2011 007 648 A1 10/2012
(Continued)

OTHER PUBLICATIONS

International Search Report corresponding to PCT Application No. PCT/EP2016/080132, dated Mar. 1, 2017 (German and English language document) (7 pages).

*Primary Examiner* — Andrew M Tecco
(74) *Attorney, Agent, or Firm* — Maginot, Moore & Beck LLP

(57) ABSTRACT

In a hand-held power tool with a drive unit comprising at least one drive motor and a transmission coupled to the drive motor for driving a working tool, wherein the transmission can be shifted between at least two different gear ratios, a communication interface is provided for communication with a guide unit operable by a user and designed to receive gearshift instructions from the guide unit for shifting the transmission between the two different gear ratios according to the specific use.

18 Claims, 20 Drawing Sheets

(56) References Cited

U.S. PATENT DOCUMENTS

| | | | | |
|---|---|---|---|---|
| 9,256,988 | B2 * | 2/2016 | Wenger | G07C 3/02 |
| 9,833,890 | B2 * | 12/2017 | Ito | H02K 11/33 |
| 10,131,042 | B2 * | 11/2018 | Mergener | B23B 47/00 |
| 10,131,043 | B2 * | 11/2018 | Mergener | B25B 21/02 |
| 10,213,908 | B2 * | 2/2019 | Mergener | B25B 23/1475 |
| 10,569,398 | B2 * | 2/2020 | Mergener | B23B 45/008 |
| 2007/0007024 | A1 | 1/2007 | Tokairin | |
| 2008/0196912 | A1 * | 8/2008 | Gass | B25F 5/021 173/4 |
| 2012/0214640 | A1 * | 8/2012 | Saur | B25B 21/00 477/15 |
| 2012/0292070 | A1 * | 11/2012 | Ito | H02K 11/35 173/217 |
| 2013/0021783 | A1 | 1/2013 | Vanko et al. | |
| 2014/0015465 | A1 * | 1/2014 | Kaizo | G05F 1/66 318/504 |
| 2014/0069672 | A1 * | 3/2014 | Mashiko | B25B 21/00 173/47 |
| 2014/0070924 | A1 * | 3/2014 | Wenger | B25F 5/00 340/10.1 |
| 2014/0107853 | A1 * | 4/2014 | Ashinghurst | B25F 5/00 700/297 |
| 2014/0240125 | A1 | 8/2014 | Burch | |
| 2014/0246893 | A1 | 9/2014 | Tesar | |
| 2014/0338946 | A1 | 11/2014 | Herr | |
| 2014/0379136 | A1 | 12/2014 | Schlegel | |
| 2015/0367497 | A1 | 12/2015 | Ito | |
| 2016/0226278 | A1 | 8/2016 | Wenger | |
| 2016/0354888 | A1 * | 12/2016 | Huber | F16D 48/06 |
| 2016/0375570 | A1 * | 12/2016 | Boeck | H02P 6/00 700/169 |
| 2017/0008159 | A1 * | 1/2017 | Boeck | G05B 19/00 |

FOREIGN PATENT DOCUMENTS

| | | | |
|---|---|---|---|
| DE | 10 2012 212 404 | A1 | 1/2014 |
| DE | 10 2012 212 417 | A1 | 2/2014 |
| DE | 10 2012 216 602 | A1 | 3/2014 |
| EP | 1 932 625 | A2 | 6/2008 |
| EP | 2 168 724 | A1 | 3/2010 |
| EP | 2 848 371 | A1 | 3/2015 |
| GB | 2404891 | B | 2/2005 |
| WO | 2013/187411 | A1 | 12/2013 |
| WO | 2015-110245 | A1 | 4/2015 |
| WO | 2015-110245 | A1 | 7/2015 |

* cited by examiner

HAND-HELD POWER TOOL COMPRISING A GEARSHIFT UNIT

This application is a 35 U.S.C. § 371 National Stage Application of PCT/EP2016/080132, filed on Dec. 7, 2016, which claims the benefit of priority to Serial No. DE 10 2015 226 088.7, filed on Dec. 18, 2015 in Germany, the disclosures of which are incorporated herein by reference in their entirety.

BACKGROUND

The present disclosure relates to a hand-held power tool having a drive unit which for driving an insert tool has at least one drive motor and a gearbox that is coupled to the drive motor, wherein the gearbox is switchable between at least two different gear ratios.

Hand-held power tools which have a drive unit having a drive motor and a switchable gearbox wherein the drive unit is assigned a gear switching unit for switching the drive unit between at least two different gear ratios, are known from the prior art. The gear switching unit herein has an activatable shifting ring for switching gears.

Moreover, a hand-held power tool having a gear switching unit which is provided with an activatable shifting ring and an actuating unit having a servomotor is known from EP 2 848 371 A1. The servomotor herein, when activated, is configured to activate the activatable shifting ring in order to switch gears between the at least two different gear ratios.

SUMMARY

The present disclosure provides a new hand-held power tool having a drive unit which for driving an insert tool has at least one drive motor and a gearbox that is coupled to the drive motor, wherein the gearbox is switchable between at least two different gear ratios. A communications interface is provided which is provided for communicating with a user guide unit that is activatable by a user and is configured to receive from the user guide unit switching instructions for switching the gearbox in an application-specific manner between the two different gear ratios.

The disclosure thus enables a hand-held power tool to be provided, in the case of which an application-specific switching of gears can be enabled in a simple and uncomplicated manner by way of the user guide unit, or of the switching instructions thereof, respectively, such that the hand-held power tool can be efficiently applied even by an inexperienced user.

The user guide unit is preferably at least in part integrated in the hand-held power tool and/or is at least in part configured as an external, separate component. A suitable user guide unit can thus be provided in a simple manner.

The user guide unit preferably has a mobile computer, in particular a mobile computer that is configured in the manner of a smart phone or tablet computer. Alternatively thereto, other, so-called "smart devices" such as, for example, a watch, eyeglasses, et cetera, can also be used as the mobile computer. Widely available mobile computers can thus be applied.

According to one embodiment, the user guide unit for communicating with the communications interface has an interactive program, in particular a smart phone app. A secure and reliable communication between the user guide unit and the communications interface can thus be enabled.

The user guide unit preferably has at least one operating element for initiating a switching procedure for switching the gearbox between the two different gear ratios, wherein the communications interface is configured to transmit a control signal to the at least one operating element in order to enable a command for initiating a switching procedure for switching the gearbox between the two different gear ratios by way of the at least one operating element to be generated. A switching procedure can thus be initiated in a simple manner.

The at least one operating element is preferably provided with an illumination means, and the control signal is configured to activate the illumination means in order for the command for initiating a switching procedure for switching the gearbox between the two different gear ratios to be visualized. A user of the hand-held power tool can thus safely and reliably identify an operating element that is to be operated in each case.

The at least one operating element is preferably configured as a switch or push-button. An uncomplicated and cost-effective operating element can thus be provided.

According to one embodiment, the at least one operating element has a display, and the control signal is configured to generate an indication for visualizing the command for initiating a switching procedure for switching the gearbox between the two different gear ratios on the display. A command for initiating a switching procedure can thus be securely and reliably indicated to a user of the hand-held power tool.

The display is preferably configured in the manner of touchscreen. A simple and cost-effective display can thus be provided.

The at least one operating element is preferably activatable for initiating a switching procedure for switching the gearbox between the two different gear ratios, and has a sensor which is configured to transmit an activation signal to the communications interface in the case of at least one operating element being activated. A respective activation of the operating element can thus be confirmed such that a further setting step can be indicated on the display, for example.

A servomotor which is configured to switch between the two different gear ratios in the case of the gearbox being activated is preferably provided. An automated switching of gears can thus be enabled.

The servomotor is preferably activatable by activating the at least one operating element. The servomotor can thus be activated in a secure and uncomplicated manner.

According to one embodiment, the communications interface is configured to transmit a control signal for activating the servomotor to the servomotor. An activation signal of the at least one operating element can thus be directed to the servomotor in a simple and secure manner.

The communications interface is preferably configured to transmit a control signal to actuators of the hand-held power tool, wherein at least one actuator, when activated by the communications interface, is configured to switch the gearbox between the two different gear ratios. The automated gear switching can thus be enabled in a simple manner.

The communications interface is preferably configured in the manner of a wireless transmission module, in particular as a radio module for the wireless communication by means of the Bluetooth standard. A secure and reliable transmission of data can thus be enabled.

BRIEF DESCRIPTION OF THE DRAWINGS

The disclosure is explained in more detail in the description hereunder by means of exemplary embodiments that are illustrated in the drawings in which.

DETAILED DESCRIPTION

Figure 1:
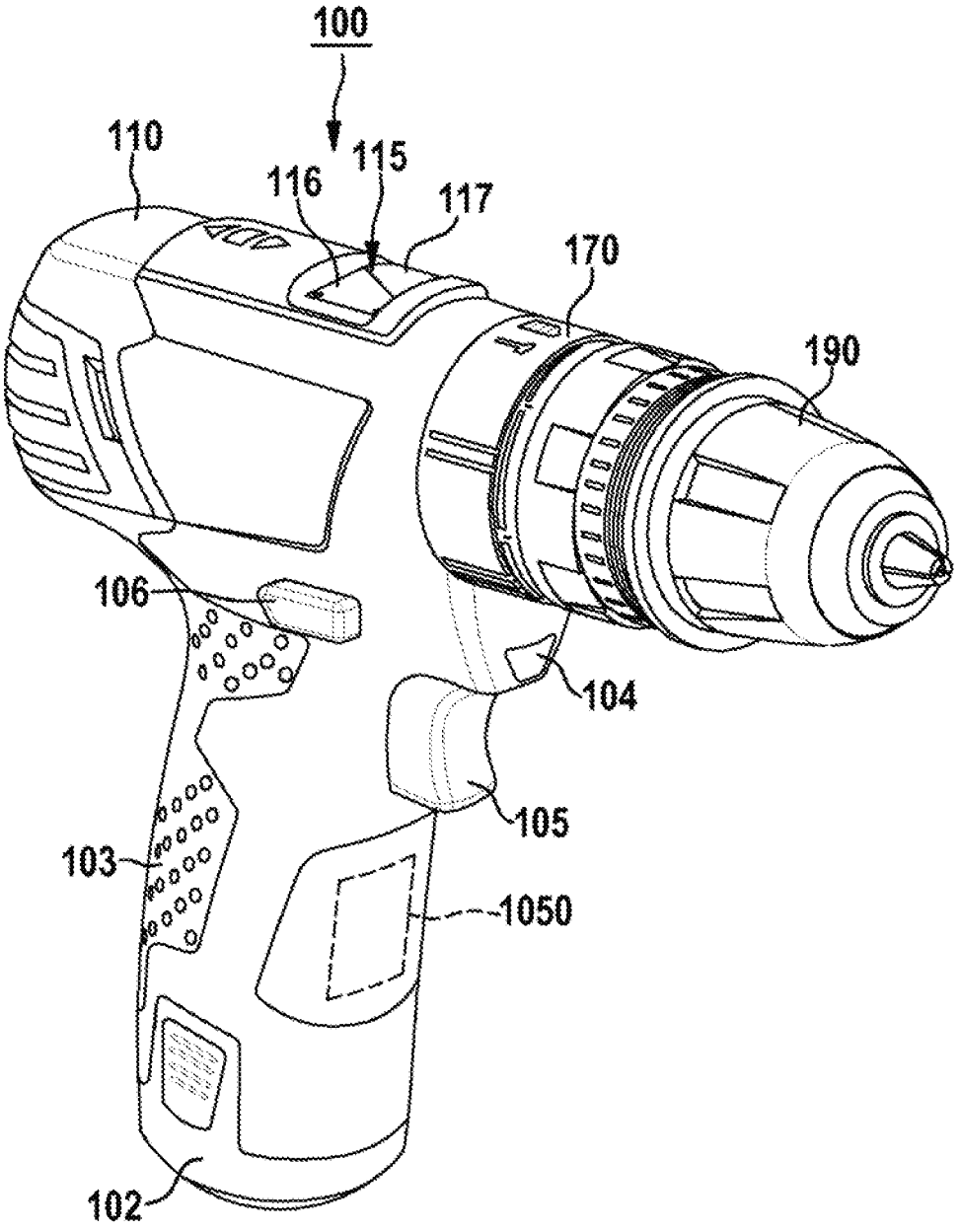
FIG. 1 shows a perspective view of a hand-held power tool having a gear switching unit and a communications interface.

FIG. 1 shows an exemplary hand-held power tool 100 having a housing 110 in which at least one drive motor (120 in FIG. 2) for driving a preferably replaceable insert tool that is disposable in a tool receptacle 190 is configured. The housing 110 herein has a hand grip 103 having a hand switch 105. The drive motor (120 in FIG. 2) is activatable, that is to say capable of being switched on and off, for example, by way of the hand switch 105, and preferably controllable or regulatable, respectively electronically in such a manner that both a reversing operation as well as parameters in terms of a desired rotational speed are implementable. Moreover, a rotation direction switch 106 is preferably disposed in the region of the hand switch 105, by way of which rotation direction switch 106 a rotation direction of the drive motor (120 in FIG. 2), or of a drive output shaft (310 in FIG. 3) that is assigned to the drive motor, respectively, can be optionally set. Furthermore, the hand-held power tool 100 is preferably connectable to a rechargeable battery pack 102 in order to be supplied with power independently from the mains supply, said hand-held power tool 100 alternatively thereto also being able to be operated from the mains supply.

The hand-held power tool 100 preferably has a switchable gearbox (130 in FIG. 2) which is switchable between at least a first and a second gear ratio. The hand-held power tool 100 is preferably configured in the manner of a percussion drill driver or drill driver, wherein the first gear ratio corresponds to a driver mode, for example, and the second gear ratio corresponds to a drilling or percussion-drill mode. However, further gear ratios can also be implemented such that, for example, the drill mode is assigned to the second gear ratio, and the percussion-drill mode is assigned to a third gear ratio, etc.

According to one embodiment, at least one user guide unit 115 which is configured at least for setting the first or the second gear ratio required in the respective current operation is provided. The user guide unit 115 herein can be configured for the active and/or passive user guidance when correspondingly switching between the first and the second gear ratio. In the case of an active user guidance, a user of the hand-held power tool 100 is preferably guided by visual, acoustic, and/or sensory instructions or commands, respectively, for switching in a corresponding switching procedure, while in the case of a passive user guidance a corresponding switching procedure is carried out automatically and is preferably only indicated to the user. Exemplary implementations of active and passive user guidance concepts will be described in detail below.

The user guide unit 115 preferably has at least one manually activatable operating unit 116, 117 having at least one, and for illustrative purposes, a first and a second manually activatable operating element 116, 117, wherein the operating elements 116, 117 are configured for initiating a switching procedure in order for the gearbox 130 to switch between different gear ratios. At least one of the two operating elements 116, 117 can preferably be configured as a switch and/or push-button.

The user guide unit 115 preferably has a mobile computer, for example a smart phone and/or a tablet computer, and/or the operating element 116, 117, can be configured as a display. According to one embodiment, the user guide unit 115 is at least in part integrated in the hand-held power tool 100 and/or is at least in part configured as an external, separate component (1040 in FIG. 10). The display herein can be integrated in the hand-held power tool 100 and/or be disposed so as to be external to the latter. Switching instructions for at least facilitating the operation of the hand-held power tool 100 and/or setting, for example an application-specific operating mode of the hand-held power tool 100, can preferably be indicated on the display to a user of the hand-held power tool 100.

The hand-held power tool 100 furthermore preferably has a communications interface 1050 which is preferably provided for communicating with the user guide unit 115 that is preferably activatable by a user, and is configured to receive at least from the user guide unit 115, switching instructions for switching the gearbox 130 in an application-specific manner between the two different gear ratios. The communications interface 1050 herein is at least configured to transmit a control signal to at least one of the operating elements 116, 117. Generating a command for initiating a switching procedure in order for the gearbox 130 to switch between the two different gear ratios, for example by way of at least one of the operating elements 116, 117, is preferably enabled herein. According to one embodiment, the communications interface 1050 is configured in the manner of a wireless transmission module, in particular as a radio module for the wireless communication by means of the Bluetooth standard. However, the transmission module can also be configured for any arbitrary other wireless and/or wired communication, for example by way of WLAN and/or LAN.

An optional working area illumination 104 is preferably disposed on the housing 110, for illustrative purposes in the region of the tool receptacle 190, in order for a working area of the hand-held power tool 100 to be illuminated. Moreover, a torque limiter element 170 for setting a maximum transmissible torque is preferably assigned to the tool receptacle 190. The torque limiter element 170 herein can be configured in the manner of a mechanical friction clutch or of an electric torque limiter.

Figure 2:
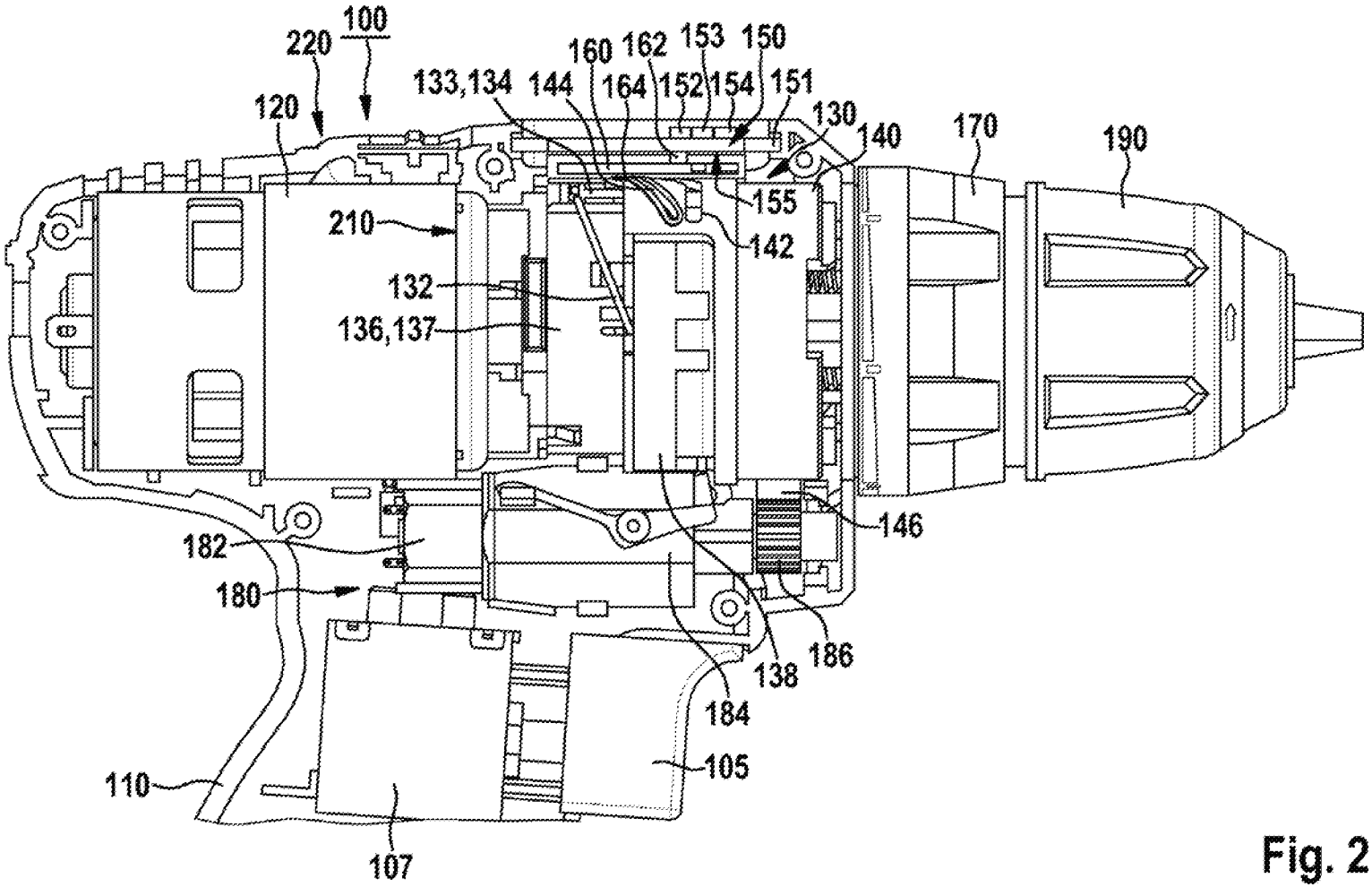
FIG. 2 shows a partial sectional side view of the hand-held power tool of FIG. 1, having a drive unit.

FIG. 2 shows the hand-held power tool 100 of FIG. 1, which for illustrative purposes has a drive unit 220 having a drive motor 120 and a switchable gearbox 130. The switchable gearbox 130 preferably has a gearbox housing 136 which for illustrative purposes is configured in two parts, having a first and a second gearbox housing part 137, 138. The first gearbox housing part 137 herein is preferably disposed so as to face the drive motor 120, and the second gearbox housing part 138 is disposed so as to face the tool receptacle 190. However, the gearbox housing 136 can also be configured in a unitary manner, or have more than two gearbox housing parts. The switchable gearbox 130 is preferably configured in the manner of a planetary gear which is preferably switchable between at least two different gear ratios, said gearbox 130 being described in more detail in FIG. 3.

According to one embodiment, the switchable gearbox 130 is assigned a gear switching unit 210 which is configured for switching the switchable gearbox 130 between at least two different gear ratios. This gear switching unit 210 preferably has at least one activatable shifting ring 140. The gear switching unit 210 moreover preferably has a transmission unit 134. The activatable shifting ring 140 is preferably rotatable at least between a first and a second rotary position, alternatively or additionally thereto, however, can also be configured so as to be axially displaceable, as is shown in an exemplary manner in FIGS. 14 to 21. The first rotary position herein preferably corresponds to a first gear ratio, and the second rotary position of the shifting ring 140 corresponds to a second gear ratio.

The transmission unit 134 is preferably configured to transmit an activation of the activatable shifting ring 140 to a preferably axially displaceable shifting element (350 in FIG. 3) of the gearbox 130. The transmission unit 134 preferably has at least one axially displaceable shifting rod 133 and a shifting bracket 132, wherein the shifting rod 133 by way of the shifting bracket 132 couples the axially displaceable shifting element (350 in FIG. 3) of the gearbox 130 to the activatable shifting ring 140 of the gear switching unit 210. The shifting bracket 132 herein is preferably mounted so as to be axially movable and/or pivotable on the shifting rod 133 and on the axially displaceable shifting element (350 in FIG. 3), said shifting bracket 132 preferably pretensioning said shifting element to a predefined shifting position. The gear switching unit 210, or the shifting element (350 in FIG. 3) preferably switches the gear ratio only when the switchable gearbox 130 is operated, such that switching gears is only possible in the operation of the switchable gearbox 130.

According to one embodiment, the shifting ring 140 has an activation gate 142 in which the shifting rod 133 at least in portions engages. In order for the description to be simplified, only the embodiment of the gear switching unit 210 having at least one rotatable shifting ring 140 and a transmission unit 134 having a pivotable shifting bracket 132 will be described hereunder. However, the shifting ring 140 and/or the shifting bracket 132 can also be axially displaceable, as described above.

The shifting ring 140 is preferably assigned a position detection unit 160 which is configured to detect a respective current shifting position of the shifting ring 140. The shifting ring 140 herein, as described above, is preferably rotatable at least between a first and a second rotary position, wherein the first rotary position corresponds to a first gear ratio, and the second rotary position corresponds to a second gear ratio. The position detection unit 160 is preferably axially displaceable at least between a first and the second detection position, wherein the first detection position is configured for detecting the first rotary position, and the second detection position is configured for detecting the second rotary position. The shifting ring 140 moreover preferably has a gate 144 that is connected to the position detection unit 160, said gate 144 being configured for axially displacing the position detection unit 160 when the activatable shifting ring 140 is activated.

The position detection unit 160 preferably has a guide element 164 and an indicator element 162, wherein the guide element 164 at least in portions engages in the gate 144. The indicator element 162 is preferably configured to indicate a respective detected shifting position of the activatable shifting ring 140.

According to one embodiment, the position detection unit 160 for detecting a respective current shifting position, or rotary position, respectively, of the activatable shifting ring 140 is assigned a sensor. According to one embodiment the sensor is configured as a linear sensor 155, and according to a further embodiment the sensor 155 is configured as an angle sensor (710 in FIG. 7).

The linear sensor 155 herein is preferably disposed on a board 151 of an electronics circuit 150 that is assigned to the position detection unit 160, and is configured to detect a respective current detection position of the position detection unit 160. The linear sensor 155 herein preferably detects a linear movement of the indicator element 162 of the position detection unit 160, and thus to indirectly detect the respective current shifting position, or rotary position, respectively, of the activatable shifting ring 140, since a corresponding linear position of the indicator element 162 corresponds in each case to an assigned shifting position, or rotary position, respectively, of the activatable shifting ring 140. The linear sensor 155 herein is preferably assigned at least one sensor element, for illustrative purposes three sensor elements 152, 153, 154. By contrast, the angle sensor (710 in FIG. 7) can be used for detecting a respective angular position of the activatable shifting ring 140, said angular position corresponding directly to a respective shifting position, or rotary position, respectively, of the activatable shifting ring 140

According to one embodiment, the gear shifting unit 210 is assigned an actuating unit 180 having a servomotor 182. The servomotor 182 is preferably assigned a servomotor gearbox 184. The servomotor 182, when activated, is preferably configured to activate the activatable shifting ring 140 in order to switch gears between the at least two different gear ratios. The servomotor 180 herein is preferably activatable by activating the at least one operating element 116, 117, or by way of the user guide unit 115, respectively.

The communications interface 1050 is preferably configured to transmit a control signal for activating the servomotor 182 to the servomotor 182. The control signal herein can be generated as a response to an activation of the at least one operating element 116, 117. Alternatively or additionally thereto, the generation of the control signal can preferably be triggered by the user guide unit 115, that is to say for example by a mobile computer in the form of a smart phone or of a tablet computer, such that a provision of the operating elements 116, 117 can also be dispensed with. Moreover, the generation according to one embodiment can also be triggered directly by the communications interface 1050, for example so as to depend on predefined operating parameters such that a provision of the operating elements 116, 117 can again be dispensed with.

In order for the activatable shifting ring 140 to be activated when the servomotor 182 is activated, the actuating unit 180 preferably has a drive output shaft 186 which preferably drives a drive element 146 of the shifting ring 140. The drive output shaft 186 and the drive element 146 are preferably configured as mutually meshing gear wheels. A respective toothing of the drive output shaft 186 and of the drive element 146 is preferably configured so as to be spur-toothed, so as to achieve a rotation of the shifting ring 140 by a rotation of the drive output shaft 186. On account thereof, a rotation of the shifting ring 140 between the at least two rotary positions can be preferably enabled. According to one embodiment, the servomotor 182 is controllable by way of the electronics circuit 150 of the position detection unit 160, wherein a current shifting ring position can preferably be identified by way of the position detection unit 160 after a voltage interruption, for example after a change of the rechargeable battery.

FIG. 2 moreover highlights the hand switch 105 of the hand-held power tool 100, said hand switch 105 being configured for activating and deactivating the drive motor 120. The hand switch 105 is preferably assigned an on/off switch 107, wherein the hand switch 105 is preferably configured as a trigger, but can also be configured as a push-button.

Figure 3:
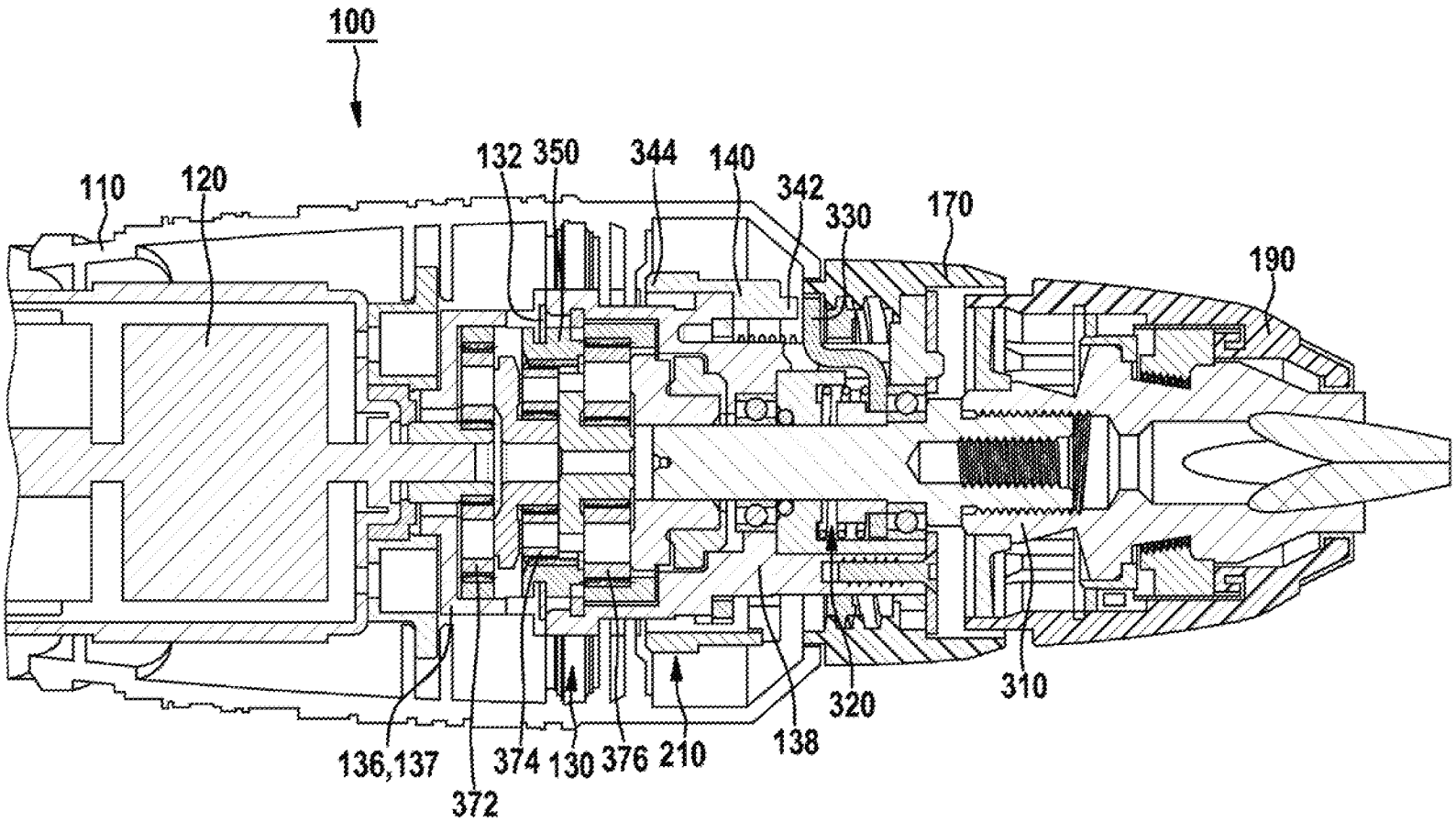
FIG. 3 shows a longitudinal section of the drive unit of the hand-held power tool of FIG. 1 and FIG. 2.

FIG. 3 shows the switchable gearbox 130 of FIG. 1 and FIG. 2, which is preferably configured as a planetary gear, for driving a drive output shaft 310 of the hand-held power tool 100 of FIG. 1. The planetary gear 130 preferably has at least one first and one second planetary ratio, for illustrative purposes, one first, one second and one third planetary ratio 372, 374, 376, which for illustrative purposes enable an operation of the planetary gear 130 at a first and a second gear ratio. Each gear ratio herein is preferably assigned to a respective operating mode, for example to a driver mode, drill mode, and/or an percussion-drill mode/percussion driver mode. For example, a driver mode for carrying out a driving procedure, having a torque limiter, can be provided in a first gear ratio, while a drilling procedure and/or a drilling or driving procedure, respectively, with an percussion function, is provided to be carried out in a second gear ratio.

The planetary gear 130 preferably has an axially displaceable shifting element 350 which is preferably configured as a shifting annulus and hereunder will be referred to as the "shifting annulus 350". The shifting annulus 350 is preferably displaceable between at least two axial positions, wherein in each case one axial position is assigned to one gear ratio. According to one embodiment, the shifting annulus 350 is configured as an annulus of the second planetary gear ratio; alternatively, however, the shifting annulus 350 can also be configured as an additional shifting annulus of the planetary gearbox 130.

FIG. 3 moreover highlights the connection of the transmission unit 134 to the planetary gearbox 130, wherein the transmission unit 134 is preferably configured to transmit an activation of the activatable shifting ring 140 to the axially displaceable shifting annulus 350 of the planetary gearbox 130. The shifting rod 133 that is assigned to the transmission unit 134 herein preferably connects the shifting annulus 350 of the planetary gearbox 130 to the activatable shifting ring 140 of the gear switching unit 210 by way of the shifting bracket 132. The shifting bracket 132 is preferably mounted so as to be pivotable on the shifting rod 133 and on the axially displaceable shifting annulus 350. Switching gears is preferably also possible in the case of a tooth-on tooth arrangement between the shifting annulus 350 and the planetary gearbox 130.

FIG. 3 moreover highlights an optional percussion mechanism 320 which for illustrative purposes is configured as a ratchet percussion mechanism and which is preferably activatable in the percussion drill mode. It is however pointed out that the design embodiment of the percussion mechanism 320 as a ratchet percussion mechanism is merely exemplary and is not to be considered as a limitation of the disclosure. The percussion mechanism 320 can thus also be configured as any other arbitrary percussion mechanism, for example as a tumbling percussion mechanism. A blocking member 330 which in the percussion mode on an end of the activatable shifting ring 140 that faces the tool receptacle 190 is impinged by deactivating elements 342 of the shifting ring 140 is provided for activating and/or deactivating the percussion mechanism 320, or a corresponding percussion mode, respectively. The shifting ring 140 at that end 344 thereof that faces the gearbox 130 herein preferably contacts the housing 110, or the gearbox housing 136, respectively.

Figure 4:
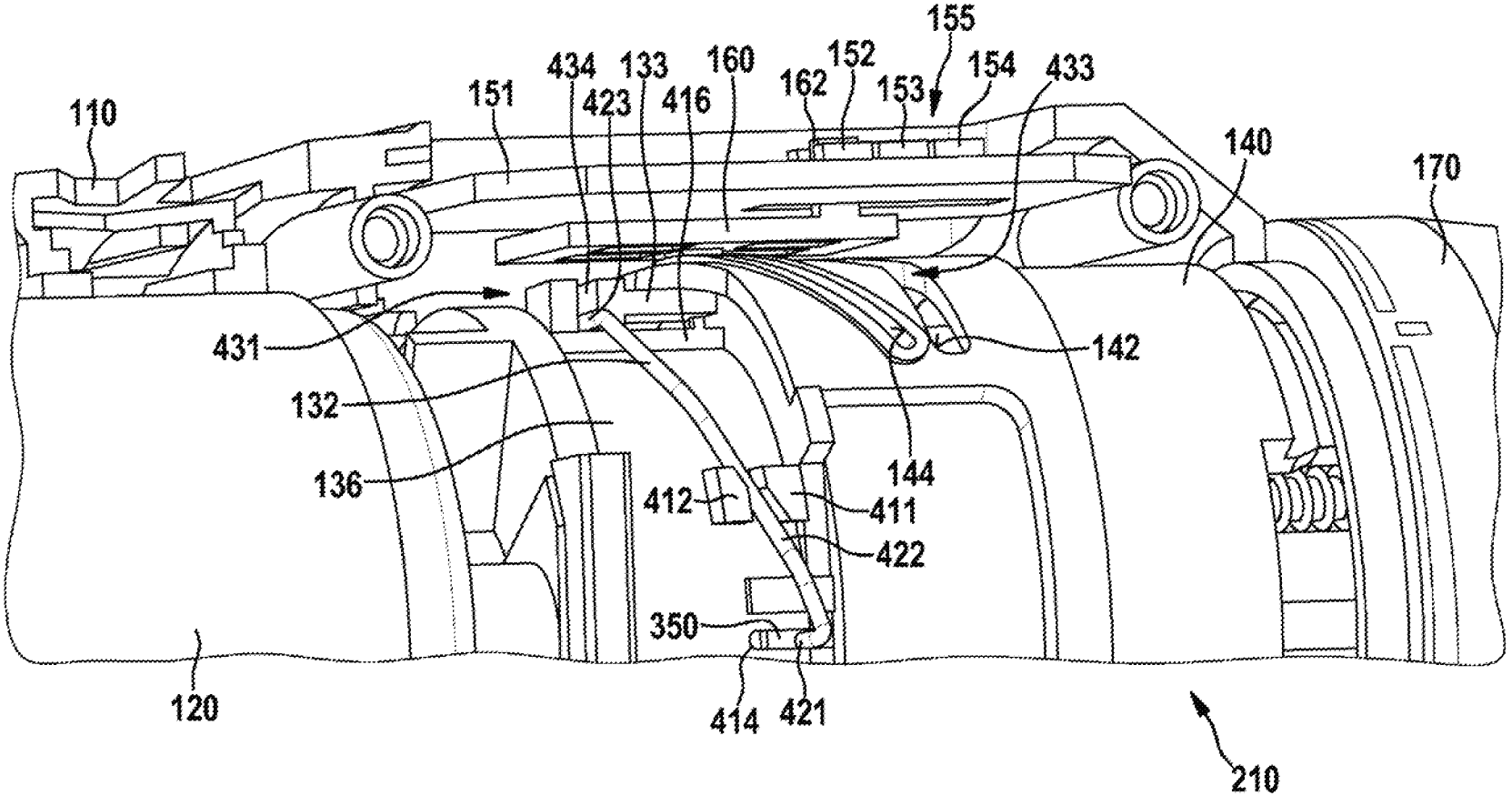
FIG. 4 shows a perspective partial view of the gear switching unit of FIG. 2, having a position detection unit.

FIG. 4 shows the transmission unit 134 having the shifting rod 133 and the shifting bracket 132 of FIG. 2. The shifting rod 133 for illustrative purposes has a first and second axial end 431, 433, wherein the first end 431 in an exemplary manner faces the drive motor 120, and the second end 433 faces the torque limiter element 170.

The shifting rod 133 is preferably disposed in a guide region 416 of the gearbox housing 136, said guide region 416 in FIG. 4 for illustrative purposes being in an upper guide region 416 of the gearbox housing 136, wherein the second end 433 of the shifting rod 133 is disposed between the shifting ring 140 and the gearbox housing 136, or on a side of the shifting ring 140 that faces the gearbox housing 136, respectively. The shifting rod 133 by way of the guide element (921 in FIG. 9) thereof that is disposed on the second end 433 at least in portions preferably engages in the activation gate 142 of the activatable shifting ring 140. The shifting rod 133 at the first end 431 thereof has a receptacle 434 for receiving the shifting bracket 132, said receptacle 434 preferably being in the manner of a groove.

According to one embodiment, the shifting bracket 132 for disposal in the groove-type receptacle 434 of the shifting rod 133 has a receptacle region 423. The receptacle region 423 is connected to an end region 421 preferably by way of a connection region 422. The end region 421 for disposal on the switching annulus 350 herein preferably by way of a clearance 414 of the gearbox housing 136 engages through the gearbox housing 136.

The shifting bracket 132 in the region of the connection region 422 is preferably guided by way of at least one, for illustrative purposes a first and a second, guide web 411, 412 of the gearbox housing 136. The shifting bracket 132 is preferably configured so as to be at least approximately U-shaped, wherein only one side of the shifting bracket 132 is shown in FIG. 4, and wherein the opposite side is preferably configured in a manner analogous to the side shown in FIG. 4. The switching bracket 132 is moreover preferably configured as a wire bracket.

Figure 5:
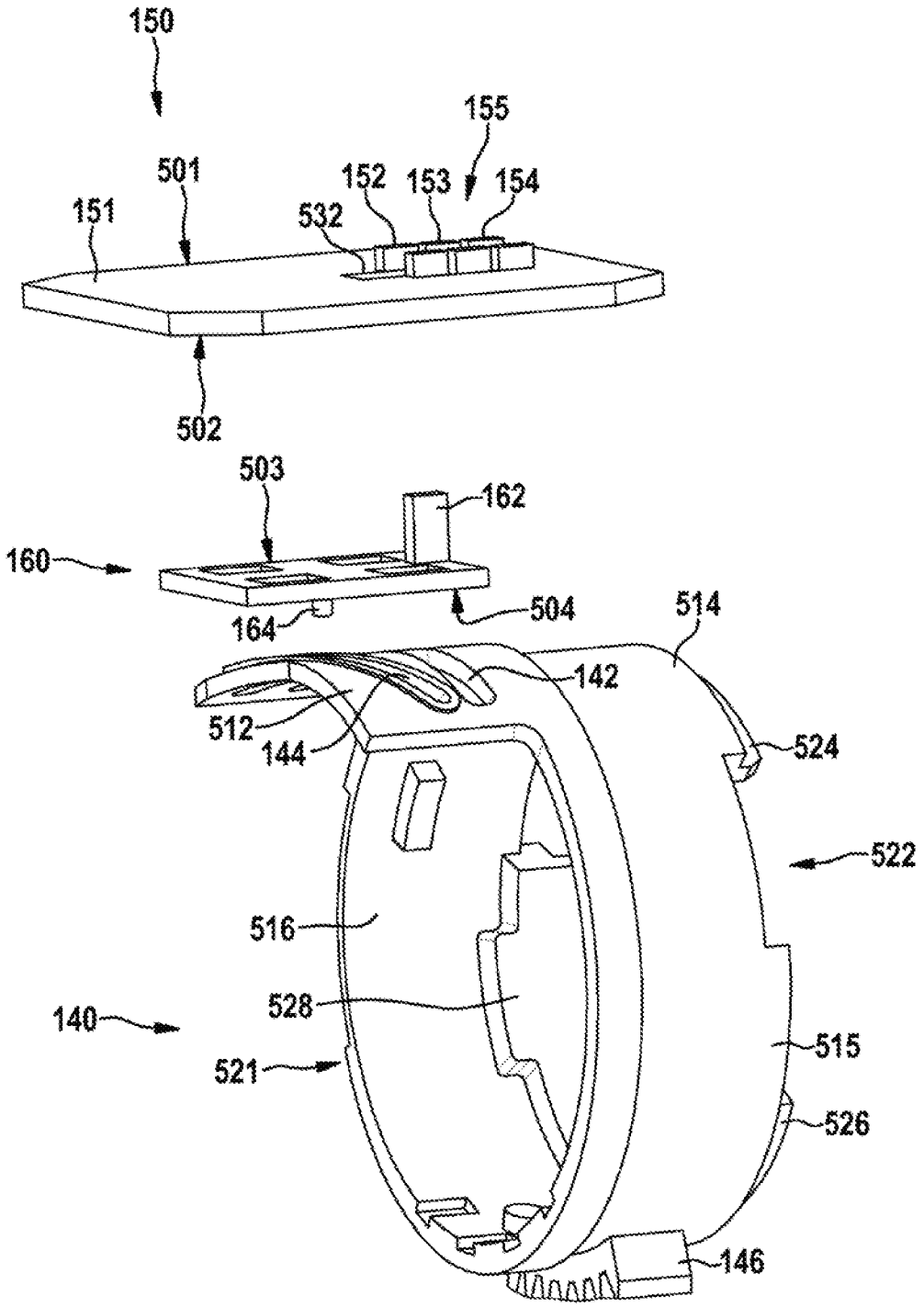
FIG. 5 shows an exploded view of the position detection unit of FIG. 2 and FIG. 4.

FIG. 5 shows the position detection unit 160 of FIG. 2, having the indicator element 162 and the guide element 164, wherein the indicator element 162 is preferably disposed on an upper side 503 of the position detection unit 160, and the guide element 164 is disposed on the lower side 504 of said position detection unit 160. For illustrative purposes, the upper side 503 herein faces a lower side 502 of the board 151, and the sensor 155 which is preferably configured as a linear sensor is disposed on an upper side 501 of the board 151. The board 151 preferably has a clearance 532, the indicator element 162 of the position detection unit 160 for indicating a respective detected shifting position of the activatable shifting ring 140 protruding through said clearance 532. FIG. 5 moreover highlights the disposal of the guide element 164 at least in portions in the gate 144 of the activatable shifting ring 140. The shifting ring 140 herein preferably faces the lower side 504 of the position detection unit 160.

According to one embodiment, the activatable shifting ring 140 has a preferably cylindrical main body 514 having a first and the second axial end 521, 522, and an external circumference 515 and internal circumference 516. The main body 514 at least in portions preferably has an axial widening region 512 which is preferably configured at the first end 521 of the shifting ring 140, but can also be configured at the second end 522. The widening region 512 herein is preferably configured so as to be arcuate and according to a first embodiment is provided with the gate 144 and the activation gate 142. The gate 144 for illustrative purposes herein is disposed so as to be closer to the first end 521 than the activation gate 142. However, the activation gate 142 could also be disposed so as to be closer to the first end 521 than the gate 144.

The main body 514, preferably on the external circumference 515 thereof, furthermore has the drive element 146 for driving the shifting ring 140 by way of the actuating unit 180 of FIG. 2. The drive element 146 is preferably configured as a circular or circular-segment-shaped gear or sprocket element, respectively. Moreover, at least one, and for illustrative purposes three, cam members 524, 526, 528 for deactivating the percussion mechanism 320 and/or for torque limitation is/are preferably disposed on the axial end 522 of the main body 514, said cam members 524, 526, 528 in an exemplary manner configuring the deactivation elements 342 of FIG. 3.

Figure 6:
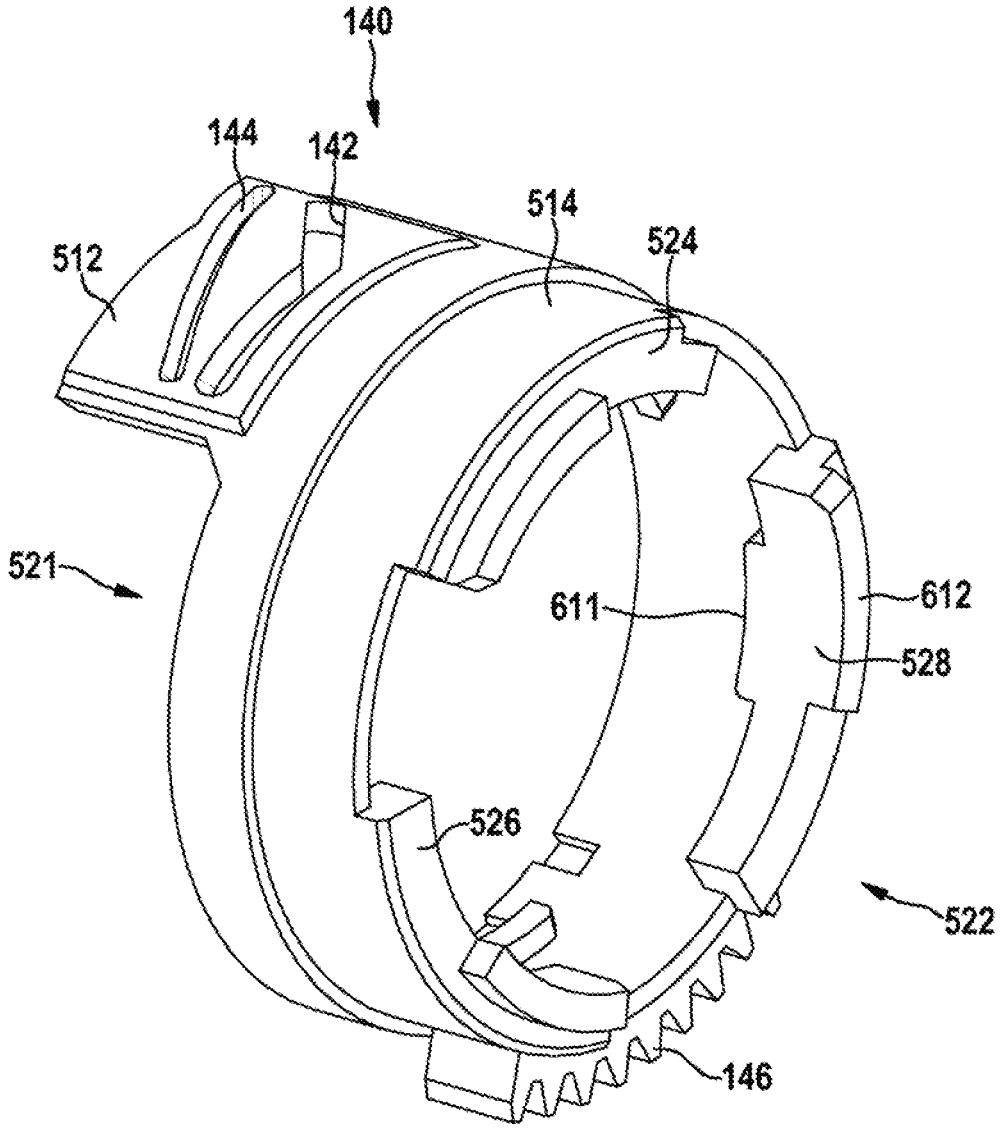
FIG. 6 shows a perspective side view of a shifting ring that is assigned to the position detection unit of FIG. 4 and FIG. 5, according to a first embodiment.

FIG. 6 shows the shifting ring 140 of FIG. 5, which is configured according to a first embodiment and preferably has the three cam members 524, 526, 528. Each of the cam members 524, 526, 528 herein preferably has at least one axial widening 611, 612, wherein a first widening 611 is configured in the direction of the first end 521 of the shifting ring 140, and a second widening 612 is configured in the direction of the second end 522 of the shifting ring 140. According to one embodiment, the first widening 611 is configured for torque limitation, and the second widening 612 is configured for deactivating the percussion mechanism 320.

Figure 7:
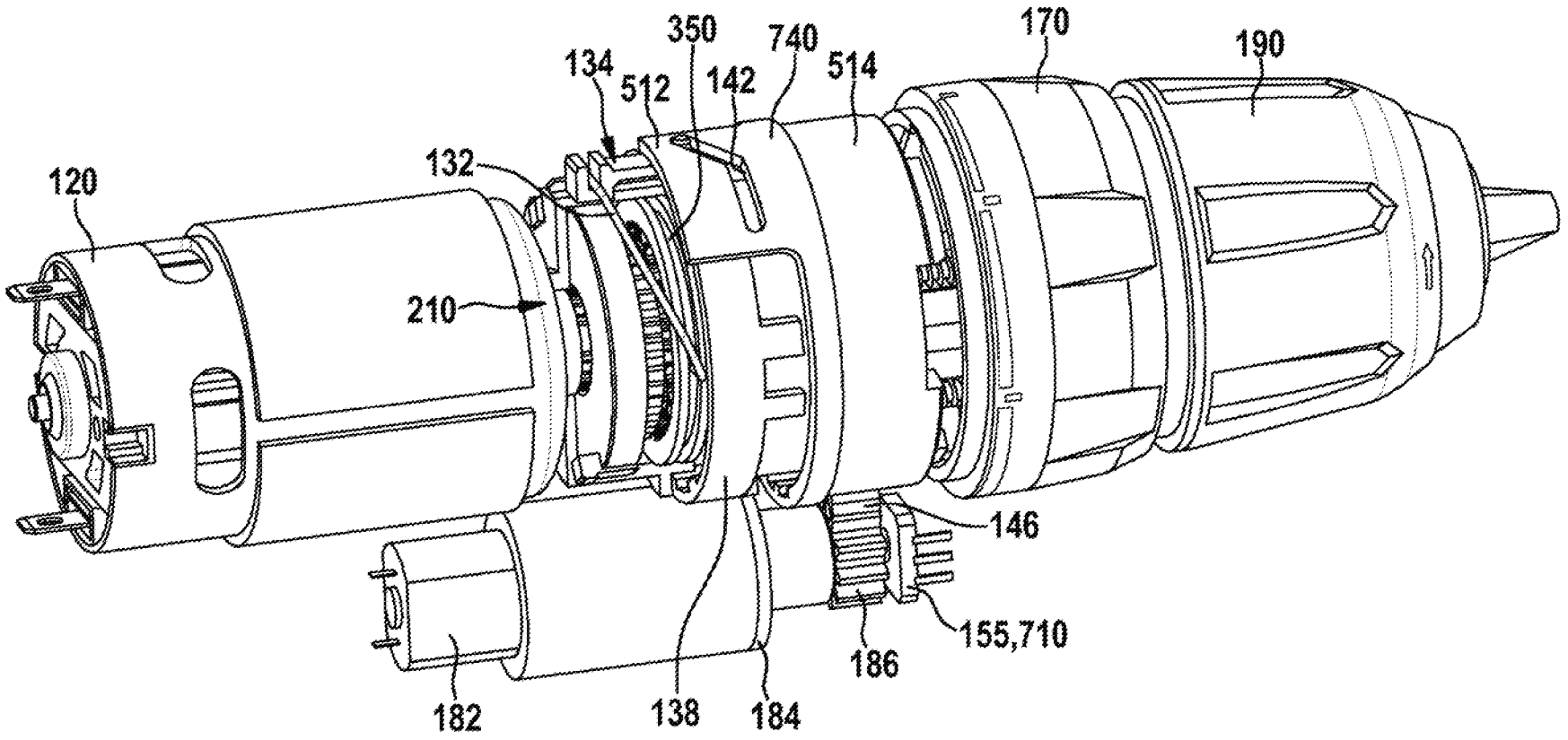
FIG. 7 shows a perspective side view of the gear switching unit of FIG. 4, having a shifting ring according to a second embodiment.

FIG. 7 shows the gear switching unit 210 of FIG. 2, having an activatable shifting ring 740 according to a second embodiment, without the first gear box housing part 137. The activatable shifting ring 740 herein is configured in a manner analogous to that of the shifting ring 140 of FIG. 1 to FIG. 6, but the widening region 512 has only the activation gate 142. Furthermore, the position detection unit 160 for detecting a respective current shifting position of the activatable shifting ring 740 is assigned the sensor 155 which is preferably configured as the angle sensor 710. For illustrative purposes, the angle sensor 710 is disposed in the region of the actuating unit 180, in particular on the drive output element 186. However, the angle sensor 710 could also be disposed in the region of the shifting ring 740.

Figure 8:
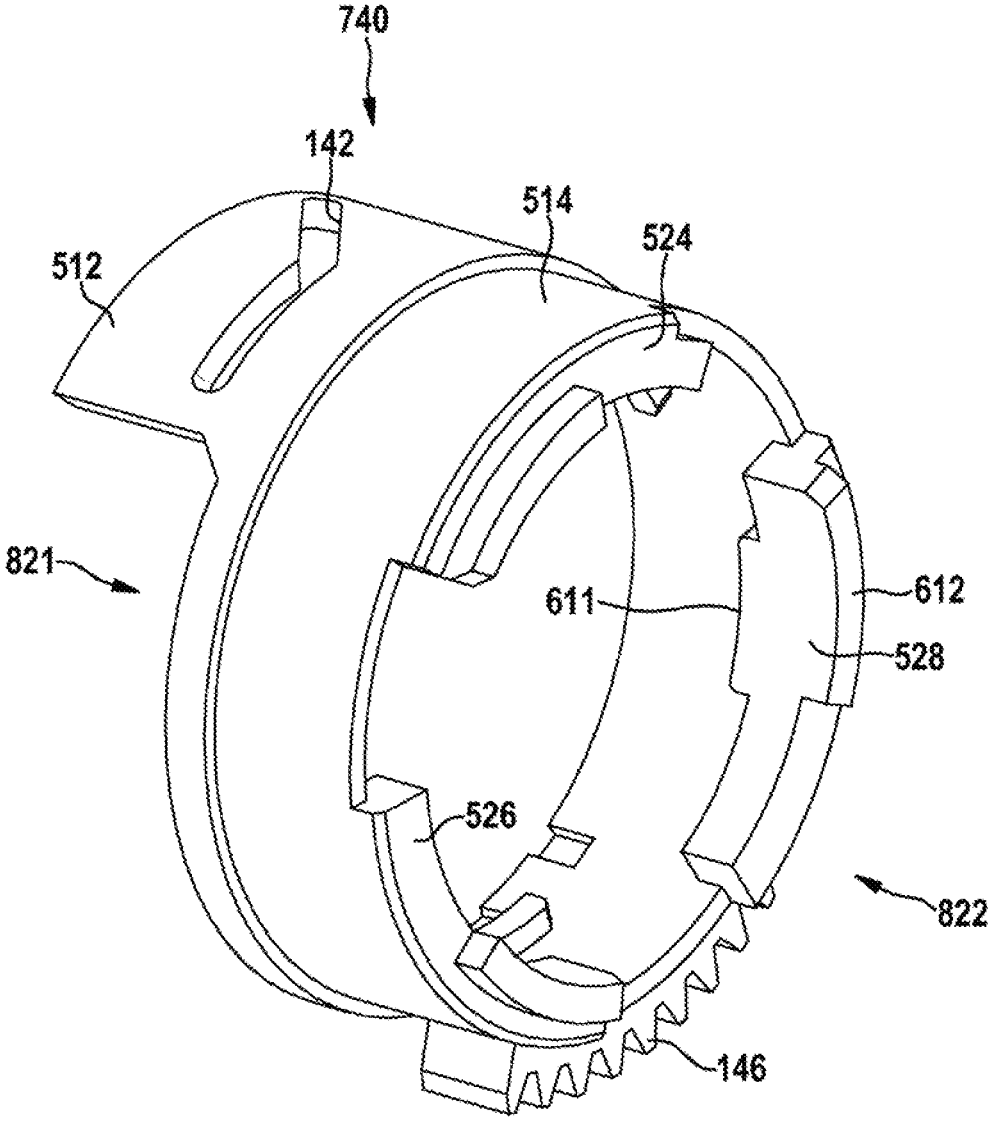
FIG. 8 shows a perspective side view of the shifting ring of FIG. 7.

FIG. 8 shows the activatable shifting ring 740 of FIG. 7, having the first and the second end 821, 822 thereof, wherein the widening region 512 is disposed on the first end 821 of the shifting ring 740, in a manner analogous to that of the activatable shifting ring 140 of FIG. 1 to FIG. 6. FIG. 8 herein highlights the widening region 512 having the activation gate 142.

Figure 9:
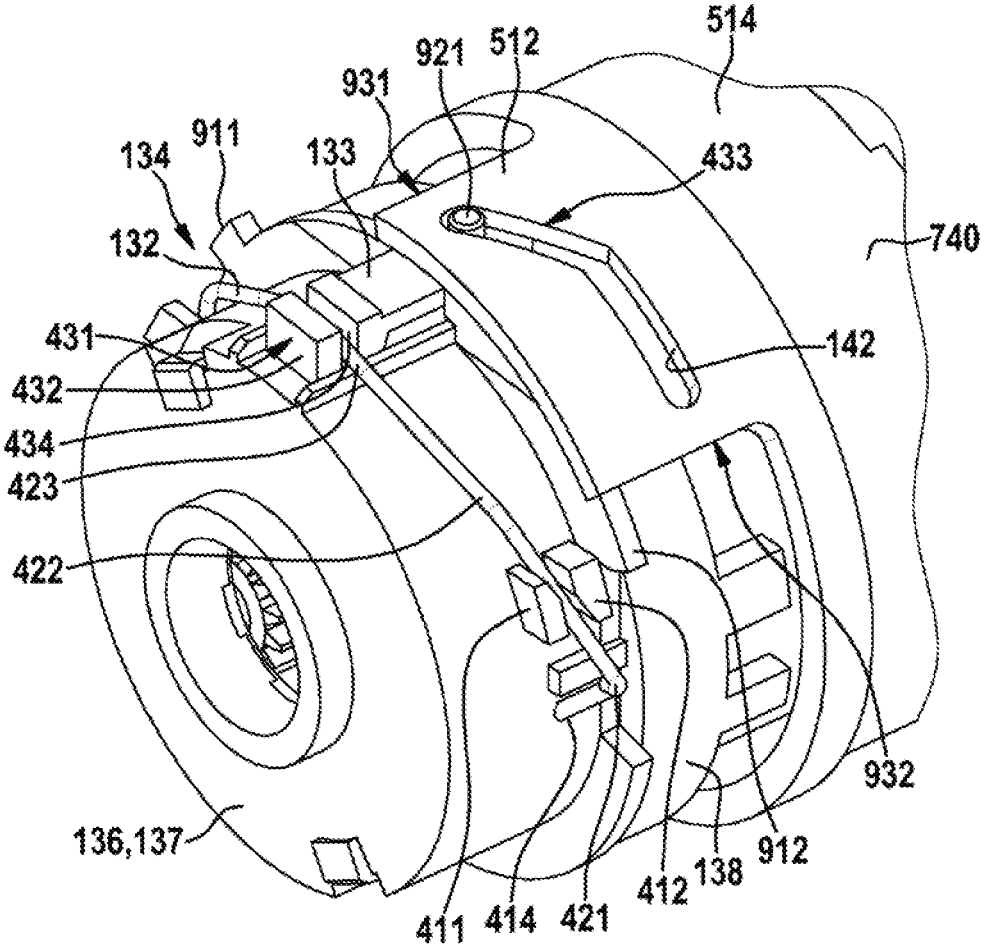
FIG. 9 shows a perspective partial view of the gear switching unit having the shifting ring according to the second embodiment.

FIG. 9 shows the gear switching unit 210 of FIG. 2, having the activatable shifting ring 740 of FIG. 7 and FIG. 8, and highlights a guide element 921 which is configured at the second end 433 of the shifting rod 133 and which for switching gears is at least in portions disposable in the activation gate 142. According to a further embodiment, the widening region 512 of the shifting ring 740 has a first and a second detent edge 931, 932. Moreover, the first gear box housing part 137 has at least one, for illustrative purposes two, detent elements 911, 912. The second detent edge 932 herein preferably, in a rotary position of the shifting ring 740 illustrated in FIG. 9, which corresponds for example to the driver mode, in an exemplary manner bears on the second detent element 912, and the first detent edge 931 faces the first detent element 911, wherein the first detent edge 931 in a further rotary position of the shifting ring 740, which corresponds to the percussion mode, would bear on the first detent element 911.

Figure 10:
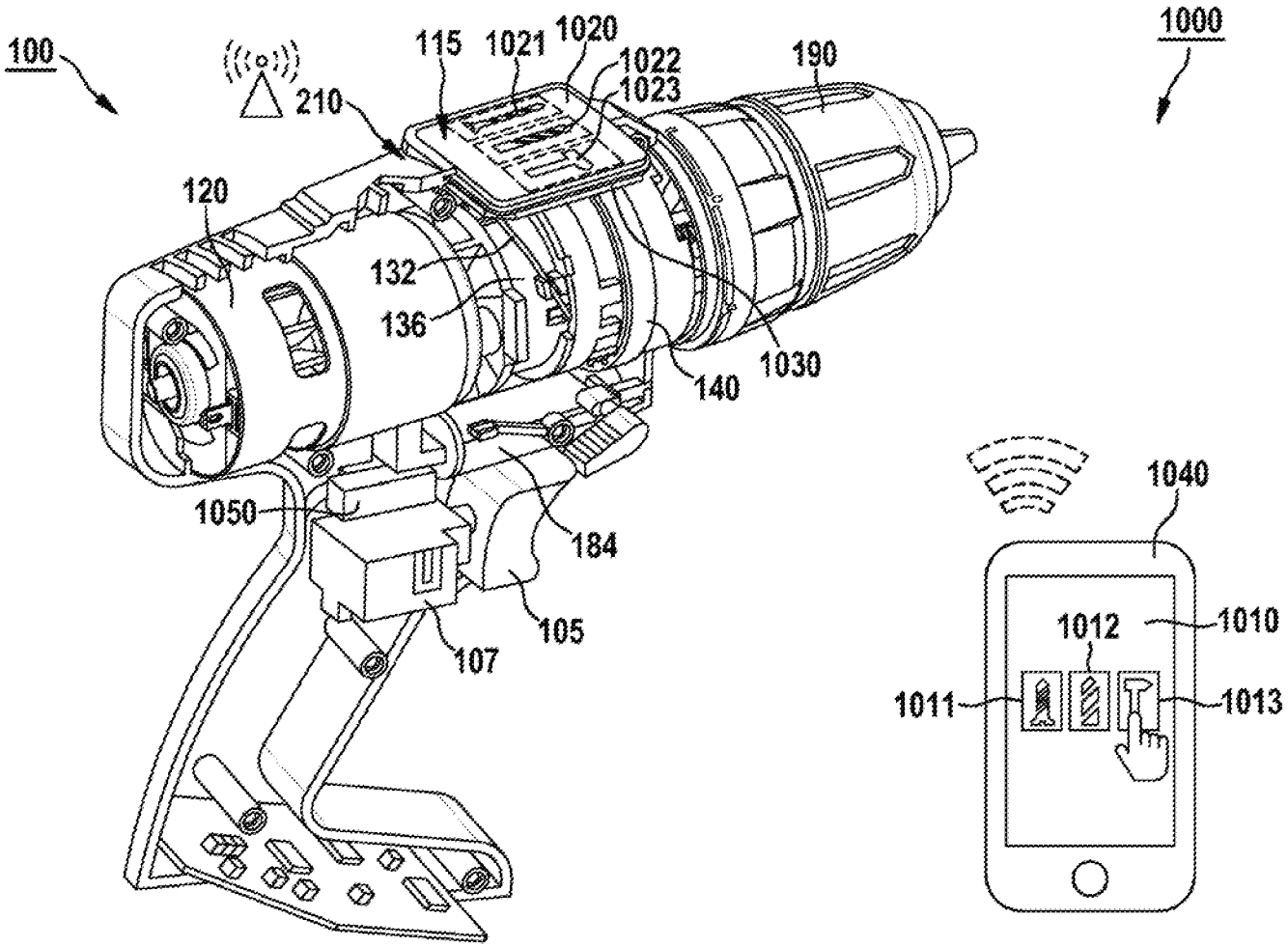
FIG. 10 shows a perspective view of a system composed of the hand-held power tool of FIG. 1 and of an operating unit according to a first embodiment.

FIG. 10 shows the hand-held power tool 100 of FIG. 1, having the gear switching unit 210 of FIG. 2, which according to one embodiment has the activatable shifting ring 140 and the actuating unit 180 of FIG. 7, and the communications interface 1050 of FIG. 1. The hand-held power tool 100 is moreover provided with the user guide unit 115 of FIG. 1, which presently preferably has an operating unit 1020 for manually setting a gear ratio, or an operating mode, respectively.

The operating unit 1020 is preferably provided with at least one, for illustrative purposes three, operating elements 1021, 1022, 1023 for setting a gear ratio, or an operating mode, respectively. The operating element 1021 for illustrative purposes is provided for setting the driver mode, the operating element 1022 for setting the drill mode, and the operating element 1023 for setting the percussion mode, wherein the operating elements 1021 to 1023 in an exemplary manner have symbols that correspond to the operating modes. The operating elements 1021 to 1023 are preferably disposed on a board 1030. The operating unit 1020 herein is preferably at least in part integrated in the hand-held power tool 100.

Herein, or alternatively thereto, the user guide unit 115 at least in part can be configured as an external, separate component 1040, as described above. In this case, the external component 1040 preferably has a mobile computer, in particular in the manner of a smart phone and/or tablet computer. Alternatively thereto, other so-called "smart devices" such as, for example a watch, eyeglasses, etc., can also be used as a mobile computer. A provision of the operating unit 1020 herein can be dispensed with, as has also been described above, in particular should the latter be implemented by the mobile computer. In order for a setting operating mode to be indicated, the hand-held power tool 100 preferably has a display. In this case, the user guide unit 115 conjointly with the hand-held power tool 100 preferably forms a tool system 1000.

The mobile computer 1040 preferably has a display 1010 which is preferably configured in the manner of a touchscreen, or so as to be controlled by gestures, respectively. The display 1010 for inputting at least one operating mode of the hand-held power tool 100 preferably has at least one, for illustrative purposes three, operating elements 1011, 1012, 1013. The operating elements 1011 to 1013 in FIG. 10 for illustrative purposes are configured as operating panels on the display 1010, but could also be configured as switches and/or push-buttons.

In the case of the user guide unit 115 having both the operating unit 1020 as well as the mobile computer 1040, the control signal described above is preferably configured to generate an indication for commanding initiation of a switching procedure for switching the gearbox 130 between the different gear ratios on the display 1010. Instructions herein are preferably indicated by way of the display 1010, for example an instruction which operating mode is to be set for a predefined operating step, a user of the hand-held power tool 100 subsequently being able to set said instruction, for example by way of the operating unit 1020. The operating elements 1021 to 1023 on the hand-held power tool 100 herein can be provided with illumination means (1231, 1232, 1233 in FIG. 12), and the control signal in this case is configured to in each case activate a corresponding illumination means (1231, 1232, 1233 in FIG. 12).

The mobile computer 1040 can moreover at least in part also be integrated in the hand-held power tool 100, and setting the operating mode is preferably in each case performed automatically, preferably by way of the actuating unit 180. It is pointed out that the exemplary implementations of the user guide unit 115 described in FIG. 10 are combinable with one another in an arbitrary manner, and the communications interface 1050 can, for example, also assume the functions of the user guide unit 115.

Figure 11:
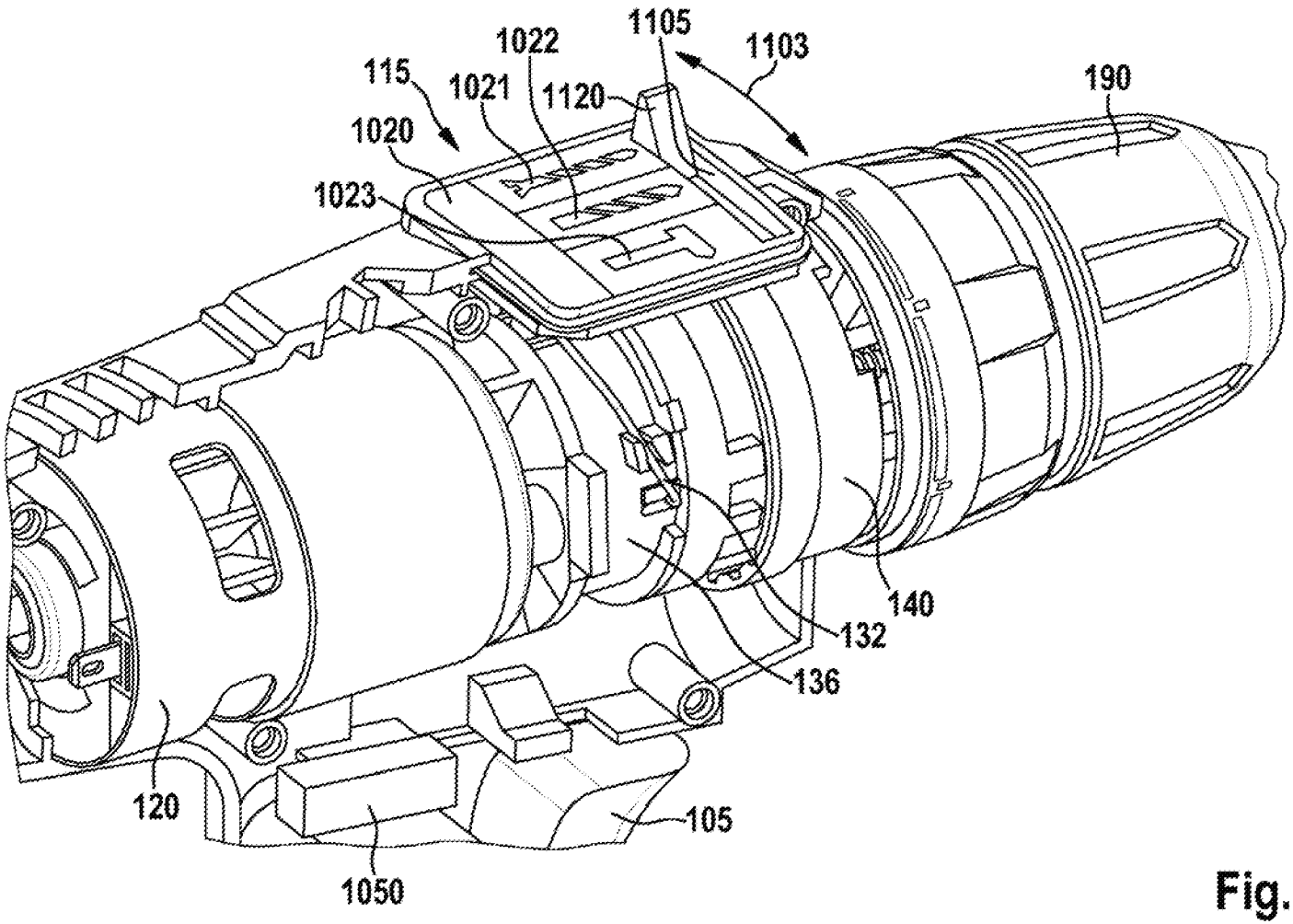
FIG. 11 shows a perspective partial view of the hand-held power tool of FIG. 1, having an operating unit according to a second embodiment.

FIG. 11 shows the operating unit 1020 of FIG. 10, which according to one embodiment has a setting element 1120 for manually setting the respective operating mode. The setting element 1120 herein is preferably configured so as to be integral to the activatable shifting ring 140 of FIG. 2 to FIG. 6 or to the activatable shifting ring 740 of FIG. 7 to FIG. 10, and preferably protrudes through a clearance 1105 of the operating unit 1020. The shifting ring 140, or the shifting ring 740, respectively is rotated by displacing the setting element 1120 in the direction of a double arrow 1103, on account of which the respective operating mode can be set. In a manner analogous to that of FIG. 10, the operating elements 1021 to 1023 have symbols corresponding to the respective operating modes.

Figure 12:
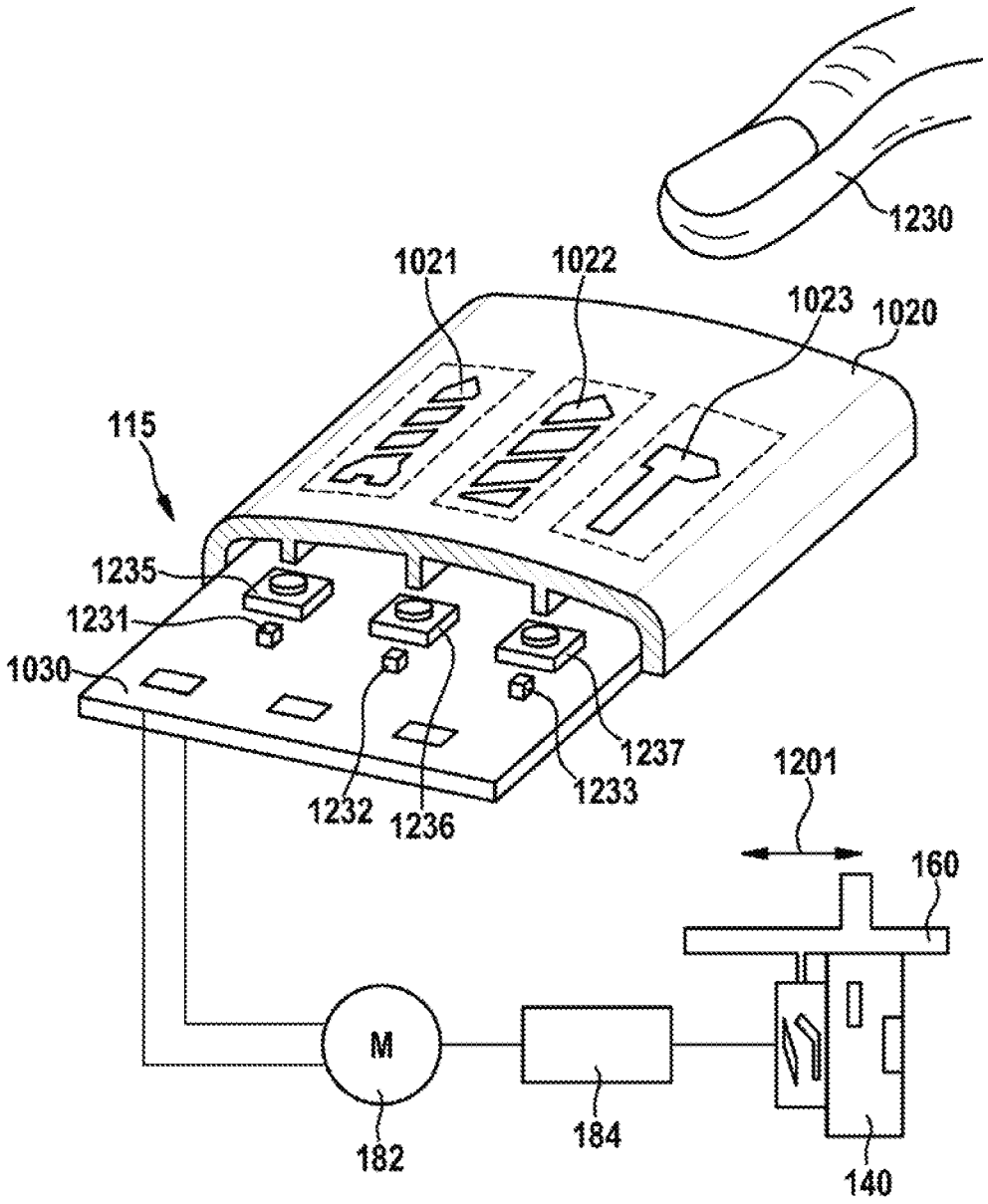
FIG. 12 shows a perspective view of the operating unit according to the first embodiment.

FIG. 12 shows the operating unit 1020 of FIG. 10, having the operating elements 1021 to 1023, and the board 1030. The board 1030 herein preferably has at least one, and for illustrative purposes, three, shifting elements 1235, 1236, 1237. Three indicator elements 1231, 1232, 1233 are preferably provided for indicating a respective set gear ratio. Said indicator elements 1231, 1232, 1233 are preferably configured as illumination elements. One shifting element 1235 to 1237 having an illumination element 1231 to 1233 herein is in each case assigned to one operating element 1021 to 1023. For illustrative purposes, the shifting element 1235 and the illumination element 1231 are assigned to the operating element 1021, the shifting element 1236 and the illumination element 1232 are assigned to the operating element 1022, and the shifting element 1237 and the illumination element 1233 are assigned to the operating element 1023.

The illumination means 1231, 1232, 1233 are preferably activatable at least for indicating the command for initiating a switching procedure for switching the gearbox 130 of FIG. 2 between the different gear ratios. The shifting elements 1235 to 1237 are preferably configured as switches or push-buttons, and/or the illumination elements 1231 to 1233 are configured in the manner of LEDs. Alternatively, the operating unit 1020 can also be configured in the manner of a display, preferably having a touchscreen, and/or of a mobile computer, wherein a respective symbol to be activated can in each case light up and/or flash on the display. The operating unit 1020 is preferably connected to the actuating unit 180, or to the servomotor 182, respectively, and to the servomotor gearbox 184, in order for an operating mode selected by a user 1230 to be set, or in order for the activatable shifting ring 140 of FIGS. 2 to 6 to be rotated, respectively, said servomotor 182 in turn being able to axially displace the position detection unit 160 preferably along a double arrow 1201.

Figure 13:
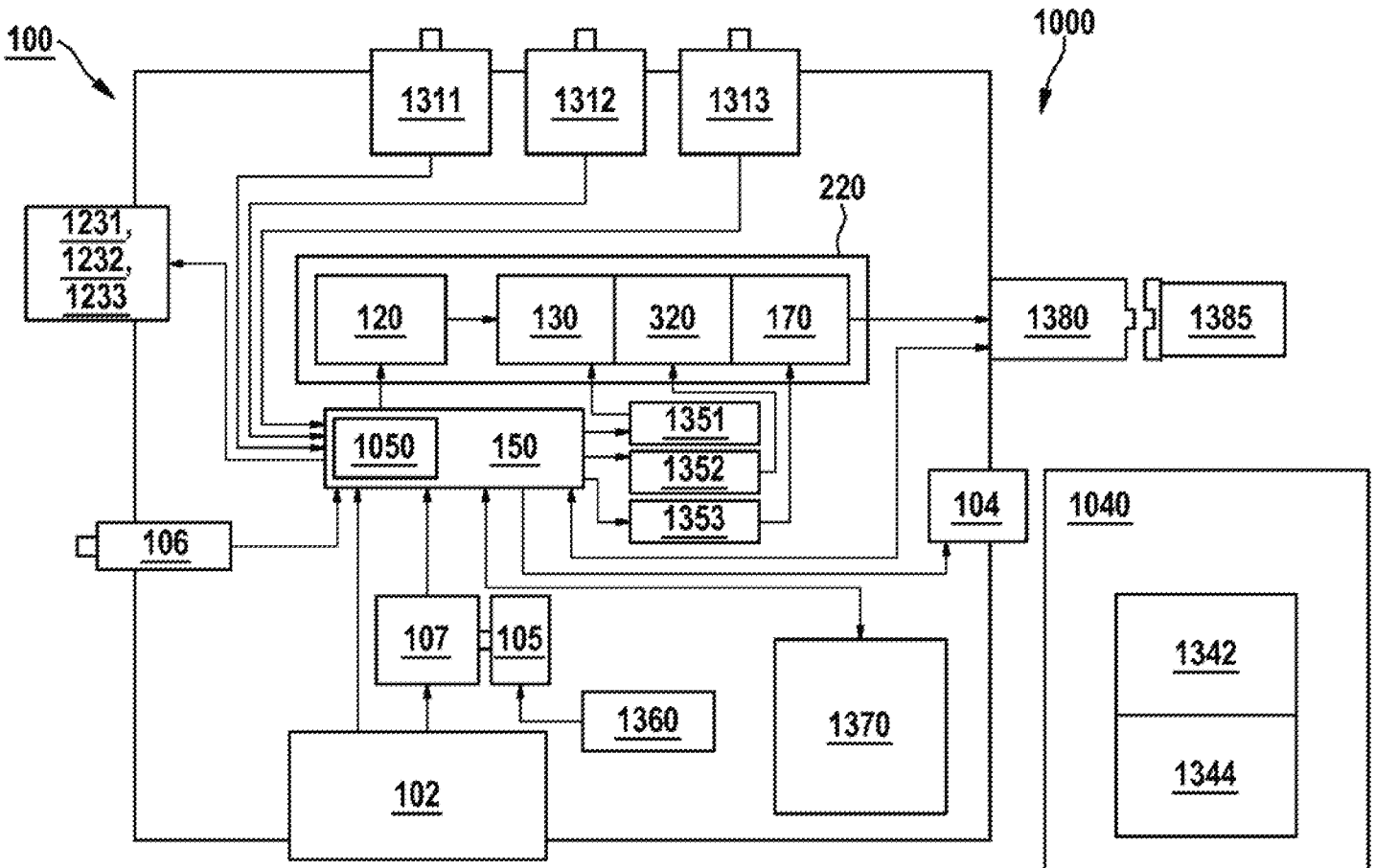
FIG. 13 shows a schematic diagram of the hand-held power tool of FIG. 1, having the exemplary gear switching unit and the communications interface.

FIG. 13 shows the tool system 1000 of FIG. 10, having the hand-held power tool 100 and the mobile computer 1040 of FIG. 10. FIG. 13 herein highlights the hand-held power tool 100 having the drive unit 220 thereof which has the drive motor 120, the gearbox 130, the percussion mechanism 320, and the torque limiter element 170. The electronics circuit 150 herein controls at least one actuator 1351, 1352, 1353. For illustrative purposes, three actuators 1351, 1352, 1353 are illustrated in FIG. 13, wherein the actuator 1351 in an exemplary manner is configured for switching gears of the gearbox 130, the actuator 1352 is configured for activating/deactivating the percussion mechanism 320, and the actuator 1353 is configured for setting a torque by means of the torque limiter element 170. The electronics circuit 150, when activating an actuator 1351 to 1353 preferably transmits an activation signal to an assigned illumination element 1231 to 1233. Alternatively or additionally, the activation signal can also be configured as a sound signal.

According to one embodiment, the mobile computer 1040 for communicating with the communications interface 1050 of the hand-held power tool 100 has an interactive program 1342, 1344, in particular a smart phone app. A first program 1342 herein is preferably configured for setting application cases, for example for driving a screw into soft timber. The program 1342 herein determines operating parameters, for example a number of revolutions, a rotation direction, a torque, a gear ratio, and/or a percussion operation requirement preferably for a respective application case, and transmits said operating parameters to the communications interface 1050 of the hand-held power tool 100.

The communications interface 1050 herein is preferably configured to transmit a control signal to the actuators 1351, 1352, 1353 of the hand-held power tool 100, wherein at least one actuator 1351, when activated by the communications interface 1050, is configured for switching the gearbox 130 between the different gear ratios. The communications interface 1050 herein preferably transmits the control signal to the electronics circuit 150 which activates and/or controls the respective actuators 1351 to 1353.

Alternatively or additionally, a second program 1344 which is configured for setting at least one specific operating parameter, for example a number of revolutions, a rotation direction, a torque, a gear ratio, and/or a percussion operation requirement is provided. Herein, a user of the hand-held power tool 100 inputs desired operating parameters directly by way of the program 1344. Said operating parameters are then transmitted to the communications interface 1050 of the hand-held power tool 100, wherein the communications interface 1050 retransmits a corresponding control signal, as described above.

Alternatively or additionally thereto, the hand-held power tool 100 for manually setting a gear ratio and/or an operating mode, or for manually setting operating modes, respectively, can have at least one signal transducer 1311, 1312, 1313. For illustrative purposes, three signal transducers 1311, 1312, 1313 are shown in FIG. 13. A first signal transducer 1311 herein, in an exemplary manner, is configured for switching gears, a second signal transducer 1312 is configured for activating and/or deactivating the percussion mechanism 320, and a third signal transducer 1313 is configured for setting a torque. The respective signal transducer 1311 to 1313 is preferably configured to transmit a control signal to the electronics circuit 150 in a manner specific to the application or dependent on the input, respectively, such that the electronics circuit 150 can activate and/or control the respective actuators 1351 to 1353. The signal transducers 1311 to 1313 herein are preferably configured as electrical signal transducers, but can also be configured as any arbitrary other signal transducer, for example as a mechanically displaceable lever arm.

The user guide unit 115 can moreover be assigned a display and/or a mobile computer 1040 which, as described above, indicates switching instructions for the application-specific switching of the gearbox 130. The switching instructions herein can be visualized as step-by-step instructions on the display and/or the mobile computer 1040. The at least one operating element 116, 117 for initiating a switching procedure for switching the gearbox 130 between the different gear ratios herein preferably has a sensor 1370 which, when the at least one operating element 116, 117 is activated, is configured to transmit an activation signal to the communications interface 1050 and/or to the mobile computer 1040 such that a respective next step of the switching instruction can be indicated.

The sensor 1370 can furthermore also be configured as an internal and/or external sensor for monitoring and/or optimizing the hand-held power tool 100, and preferably be configured as a temperature sensor, an acceleration sensor, an orientation sensor, etc. Software which is configured to verify the settings of the electronics circuit 150, or of the hand-held power tool 100 and to optionally adapt settings can be provided herein, said software emitting a warning signal and/or performing an automatic switching of gears in the case of a drive motor 120 of FIG. 1 that has run hot by virtue of an excessively high prevailing torque, for example.

An adapter interface 1380 for connecting to at least one adapter 1385 is preferably provided. The adapter interface 1380 herein can be configured in the manner of a mechanical interface, an electrical interface, and/or of a data interface, wherein the adapter 1385 is configured for transmitting items of information and/or control signals such as, for example, a torque, a number of revolutions, a voltage, a current, and/or further data to the hand-held power tool 100. The adapter 1385 in the case of an adapter interface 1380 that is configured as a data interface preferably has a transmission unit. The adapter 1385 can preferably be configured as, for example, a distance measuring unit, and can direct identified parameters to the hand-held power tool 100 by way of the adapter interface 1380. The adapter herein can be used with and/or without a drive unit 220. The adapter 1385 is preferably activatable by way of the mobile computer 1040, wherein the latter or the display can visualize an activation of the adapter 1385.

The electronics circuit 150 furthermore preferably controls the drive motor 120 and/or the operating area illumination 104. The drive motor 120 herein is preferably controlled so as to depend on a rotation direction signal that is transmitted by the rotation direction switch 106. The hand switch 105 preferably has a locking mechanism 1360 which is preferably configured as a mechanical and/or electrical locking mechanism. Furthermore, the on/off switch 107 and/or the electronics circuit 150 are/is provided with current by the rechargeable battery pack 102.

Figure 14:
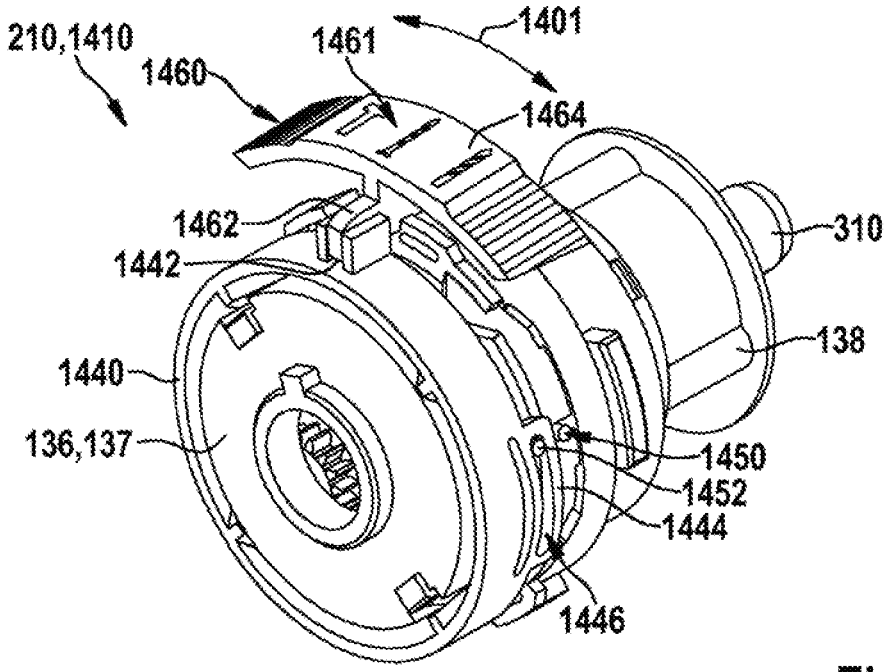
FIG. 14 shows a perspective view of a gear switching unit according to a second embodiment.

FIG. 14 shows the gear switching unit 210 of FIG. 2 which for illustrative purposes presently is manually operable by way of an alternative operating element 1460 and hereunder is referred to as the "gear switching unit 1410". The operating element 1460 is preferably configured so as to be circular-segment-shaped and on the upper side 1461 thereof has a status indicator 1464 which preferably has symbols for respective operating modes. The operating element 1460 on that end thereof that faces the first gearbox housing part 137 of FIG. 2 moreover preferably has an entrainment element 1462 which is disposed in a receptacle 1442 of an activatable shifting ring 1440 that is assigned to the gear switching unit 1410. A switching of gears, or setting of operating modes, respectively, is performed in each case by a rotating movement of the operating element 1460 in the direction of a double arrow 1401.

The activatable shifting ring 1440 preferably has a widening region 1444 having an activation gate 1446 which faces the drive output shaft 310 of FIG. 3. The shifting ring 1440 preferably has two diametrically opposite widening regions 1444.

The activatable shifting ring 1440 is preferably configured so as to be axially displaceable and rotatable, wherein the shifting ring 1440, preferably when rotated, is simultaneously axially displaced. Alternatively, the shifting ring 1440 can also be only axially displaceable by way of the operating element 1460. A shifting rod 1450 that preferably has two guide elements 1452 which are configured so as to be diametrically opposite and which are disposed in the activation gate 1446 is furthermore provided. The shifting rod 1450 herein is connected to the gearbox 130 of FIG. 2.

Figure 15:
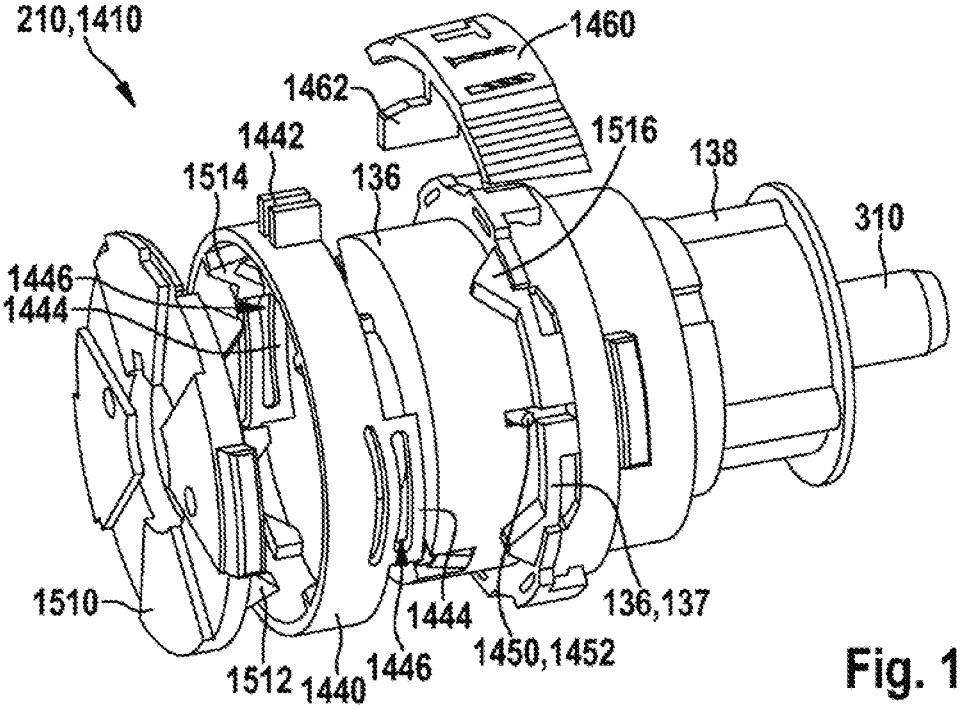
FIG. 15 shows an exploded partial view of the gear switching unit of FIG. 14.

FIG. 15 shows the gear switching unit 1410 of FIG. 14, having a fixing element 1510 for at least approximately fixing the activatable shifting ring 1440 on the first gearbox housing part 137. The fixing element 1510 is preferably configured in the manner of a disk and preferably fixes the shifting ring 1440 on the first gearbox housing part 137 by way of a clamping and/or screw connection. In order for the activatable shifting ring 1440 to be axially displaced during a rotation of the activatable shifting ring 1440, the fixing element 1510, the shifting ring 1440, and/or the gearbox housing 136 have at least one wedge-type element 1512, 1514, 1516. For illustrative purposes, the fixing element 1510 on the side thereof that faces the shifting ring 1440, preferably along the external circumference of said fixing element 1510, has at least one wedge-type element 1512, the shifting ring 1440 on the internal circumference thereof for illustrative purposes has at least one wedge-type element 1514, and the gearbox housing 136 on the external circumference thereof for illustrative purposes has at least one wedge-type element 1516. The wedge-type elements 1512 to 1516 preferably have a triangular contour, however can have any arbitrary other contour, for example an oval contour.

Figure 16:
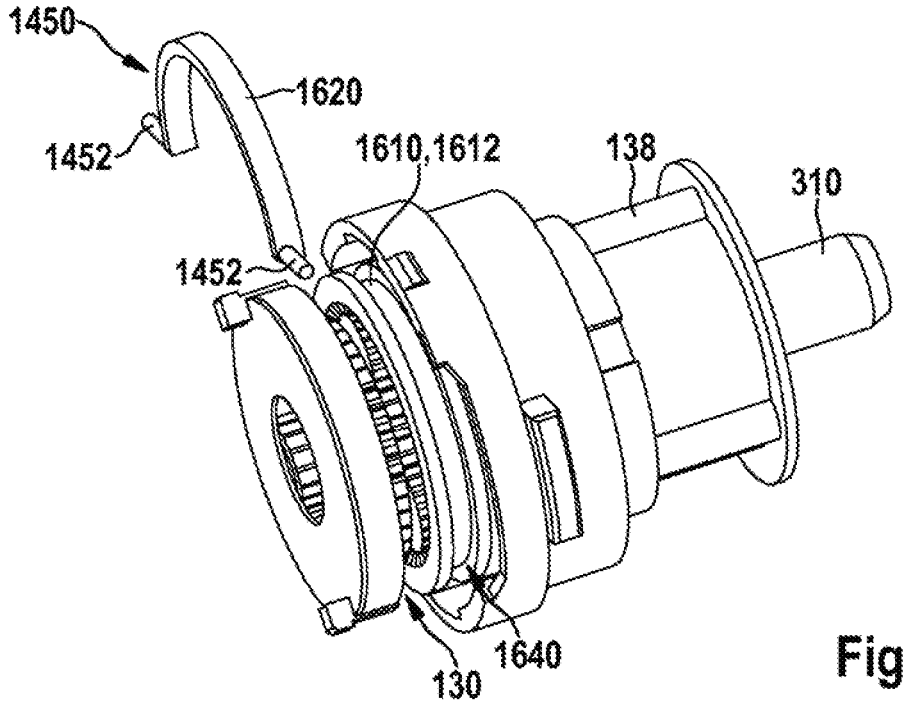
FIG. 16 shows a perspective view of the gear switching unit of FIG. 14 and FIG. 15, having a shifting rod according to a second embodiment, in the non-installed state.

FIG. 16 shows the gear switching unit 1410 of FIG. 14 and FIG. 15, without the first gearbox housing part 137 of FIG. 2, in order for the shifting rod 1450 to be highlighted. Said shifting rod 1450 for illustrative purposes has an arcuate main body 1620, in each case one guide element 1452 being configured on both ends of said main body 1620. FIG. 16 moreover highlights the gearbox 130 of FIG. 2, having an alternative shifting annulus 1610. This shifting annulus 1610 preferably has a cylindrical main body 1612 having a groove-type clearance 1640 disposing the shifting rod 1450.

Figure 17:
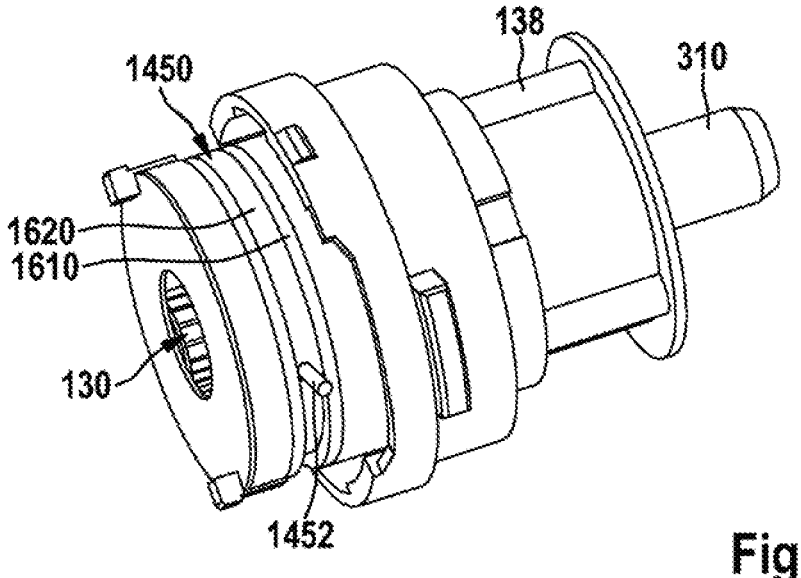
FIG. 17 shows a perspective view of the gear switching unit of FIG. 16, having the shifting rod in the installed state.

FIG. 17 shows the gear switching unit 1410 of FIG. 16, having the shifting annulus 1610 and the shifting rod 1450. FIG. 17 herein highlights the disposal of the shifting rod 1450 in the clearance 1640 of the shifting annulus 1610.

Figure 18:
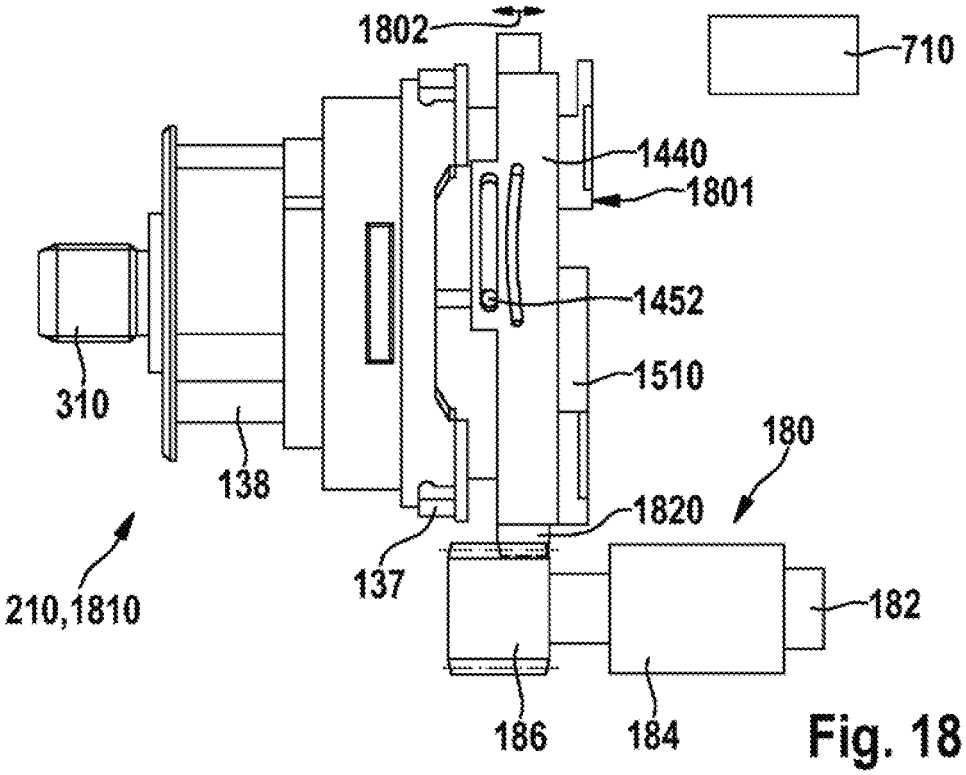
FIG. 18 shows a side view of a gear switching unit according to a third embodiment, in a first gear ratio and having a first sensor assembly.

FIG. 18 shows an alternative gear switching unit 1810 having the activatable shifting ring 1440 of FIG. 14 to FIG. 16 in an exemplary first gear ratio, or a first operating mode, respectively. In a manner analogous to that of the shifting ring 140 of FIG. 2, or 740 of FIG. 7, respectively, the shifting ring 1440 on the external circumference thereof preferably has a drive element 1820. This drive element 1820 for switching gears is preferably rotated by way of the actuating unit 180, or the drive output element 186, respectively, and herein preferably simultaneously is axially displaced in the direction of a double arrow 1802. The shifting annulus 1610 is axially displaced herein in a manner analogous to that of the shifting ring 1440 of FIG. 14.

The gear switching unit 1810 for detecting the position of the shifting ring 1440 is preferably assigned to the angle sensor 710 of FIG. 7, said angle sensor 710 according to a first variant of disposal being disposed on a rear side 1801 of the gear switching unit 1810 that is opposite the drive output shaft 310, or is disposed so as to be coaxial with the shifting ring 1440. The angle sensor 710 herein is configured to measure directly a rotation of the shifting ring 1440.

Alternatively thereto, the linear sensor 155 of FIG. 2 can be used instead of the angle sensor 710. Said linear sensor 155 is preferably configured to measure directly an axial displacement of the shifting ring 1440 which arises in a rotation of the shifting ring 1440.

Figure 19:
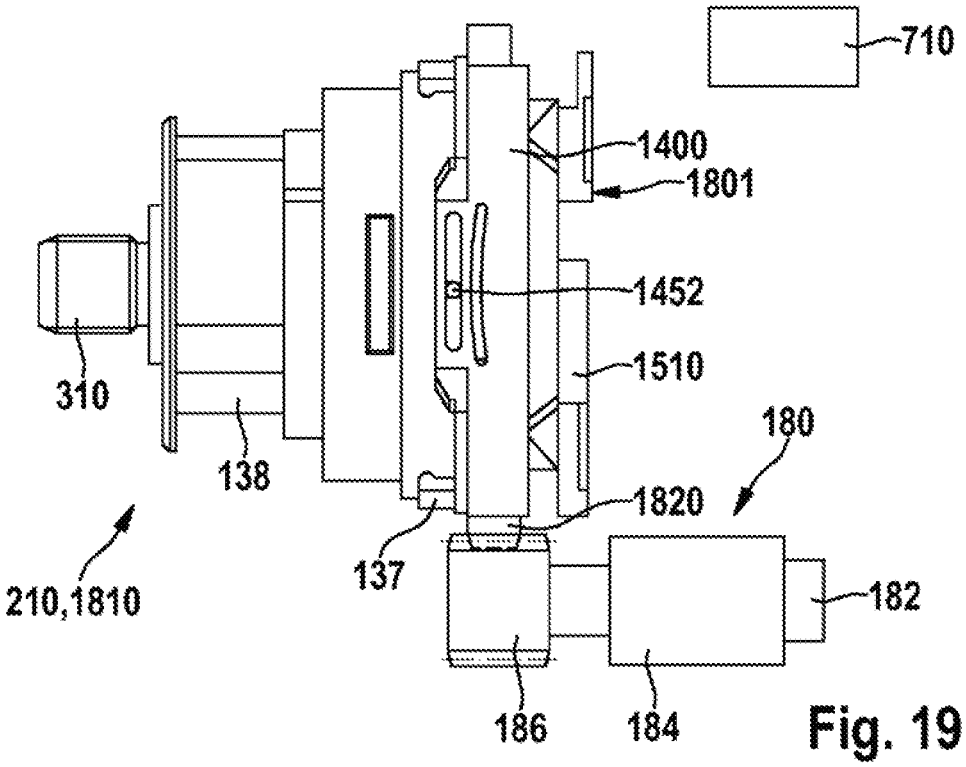
FIG. 19 shows a side view of the gear switching unit of FIG. 18, in a second gear ratio.

FIG. 19 shows the gear switching unit 1810 of FIG. 18 in an exemplary second gear ratio, or a second operating mode, respectively. The shifting ring 1440 herein, for illustrative purposes, is axially displaced in the direction of the second gearbox housing part 138 of FIG. 2.

Figure 20:
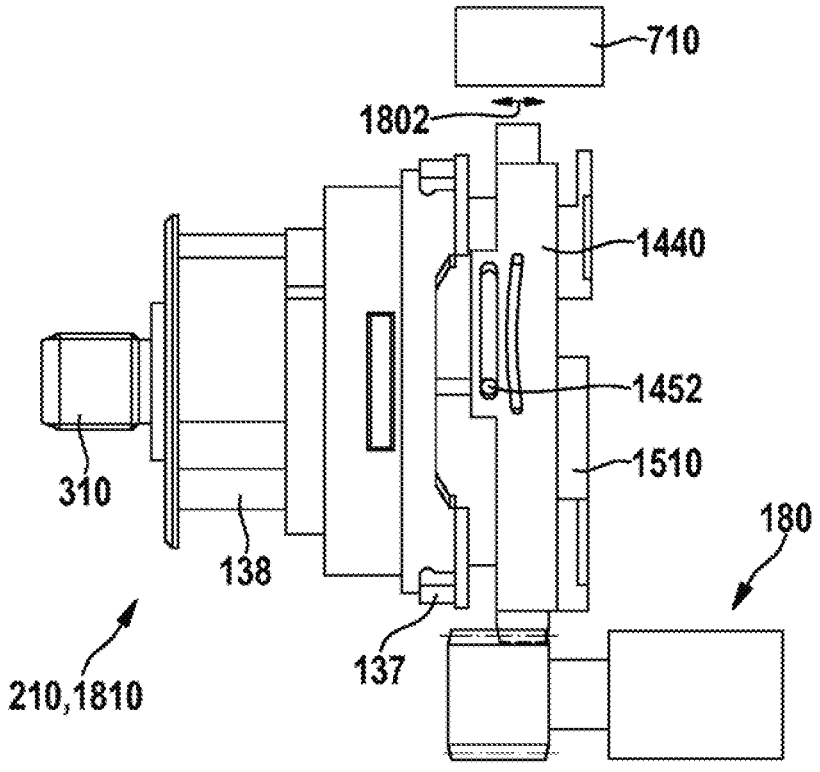
FIG. 20 shows a side view of the gear switching unit of FIG. 18 and FIG. 19, in the first gear ratio and having a second sensor assembly.

FIG. 20 shows the gear switching unit 1810 of FIG. 18 and FIG. 19, in the exemplary first gear ratio, or the first operating mode, respectively, wherein the angle sensor 710 according to a second variant of disposal in an exemplary manner is disposed in the region of the external circumference of the shifting ring 1440, or so as to be radial in relation to the shifting ring 1440. The angle sensor 710 herein, for illustrative purposes, is disposed so as to be diametrically opposite the actuating unit 180.

Figure 21:
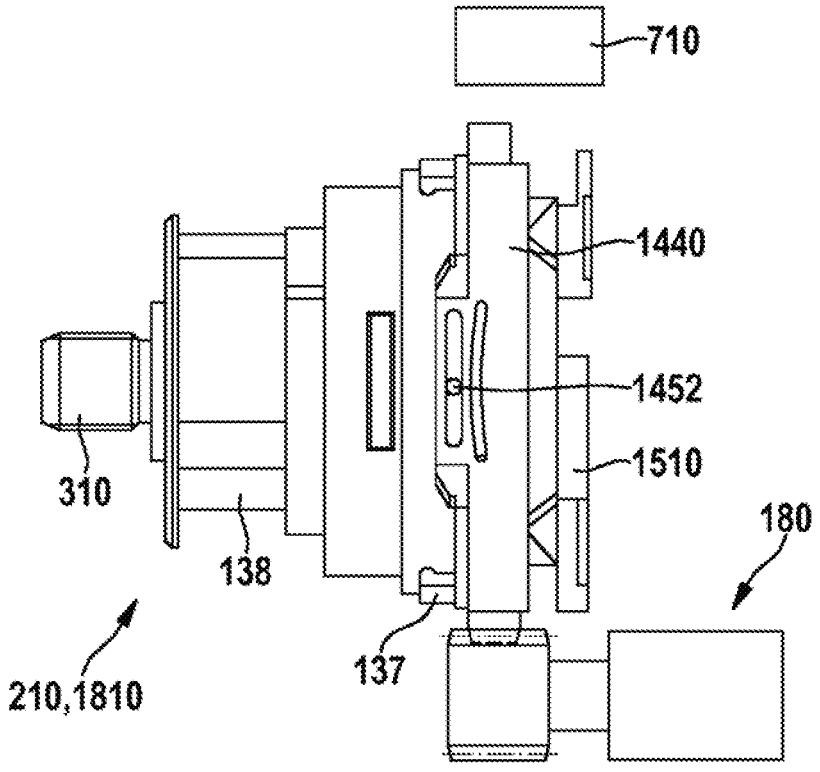
FIG. 21 shows a side view of the gear switching unit of FIG. 20, in the second gear ratio.

FIG. 21 shows the gear switching unit 1810 of FIG. 20 in the exemplary second gear ratio, or the second operating mode, respectively. The shifting ring 1440 herein, for illustrative purposes, is axially displaced in the direction of the second gearbox housing part 138.

Figure 22:
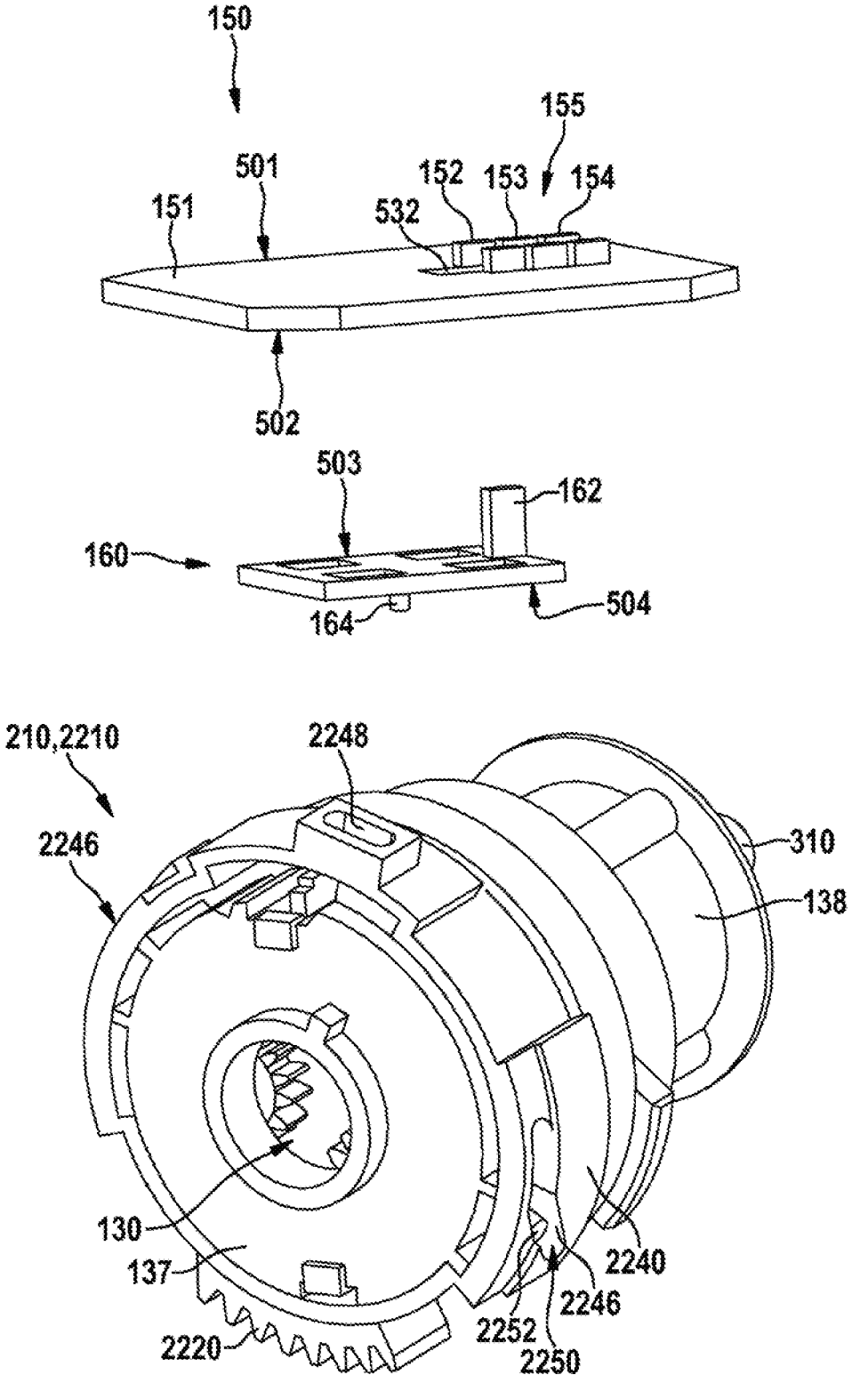
FIG. 22 shows a perspective view of a gear switching unit according to a fourth embodiment, having the position detection unit of FIG. 4 and FIG. 5.

FIG. 22 shows a further alternative gear switching unit 2210 having an activatable shifting ring 2240. In the manner analogous to the shifting rings 140, 740 and/or 1440 described above, the shifting ring 2240 has preferably on the external circumference thereof a drive element 2220 which for switching gears is rotatable by way of the actuating unit 180, or the drive output element 186 of FIG. 2, respectively. Moreover, the shifting ring 2240 on the external circumference thereof preferably has at least one activation gate, preferably two activation gates 2246 that are diametrically opposite.

A further alternative shifting rod 2250 which has two guide elements 2252 that are configured so as to be diametrically opposite is furthermore provided, said guide elements 2252 being disposed in the activation gates 2246, wherein the shifting rod 2250 is connected to the gearbox 130 of FIG. 2. The activatable shifting ring 2240 on the external circumference thereof, for illustrative purposes between the two activation gates 2246, preferably has a gate 2248 that is connectable to the position detection unit 160. Said gate 2246 is configured for axially displacing the position detection unit 160 when the activatable shifting ring 2240 is activated.

Figure 23:
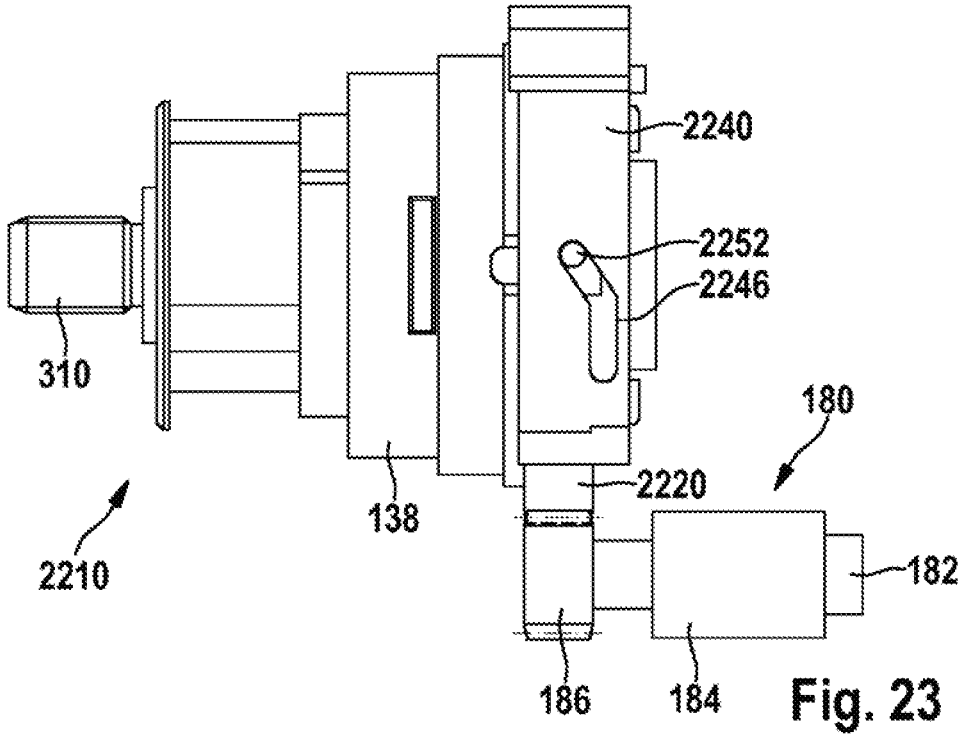
FIG. 23 shows a side view of the gear switching unit of FIG. 22 in a first gear ratio.

FIG. 23 shows the gear switching unit 2210 of FIG. 22, wherein the drive element 2220 is connected to the actuating unit 180. For illustrative purposes, the activatable shifting ring 2240 is disposed in the first rotary position thereof which is assigned to the first gear ratio, or to a first operating mode, respectively.

Figure 24:
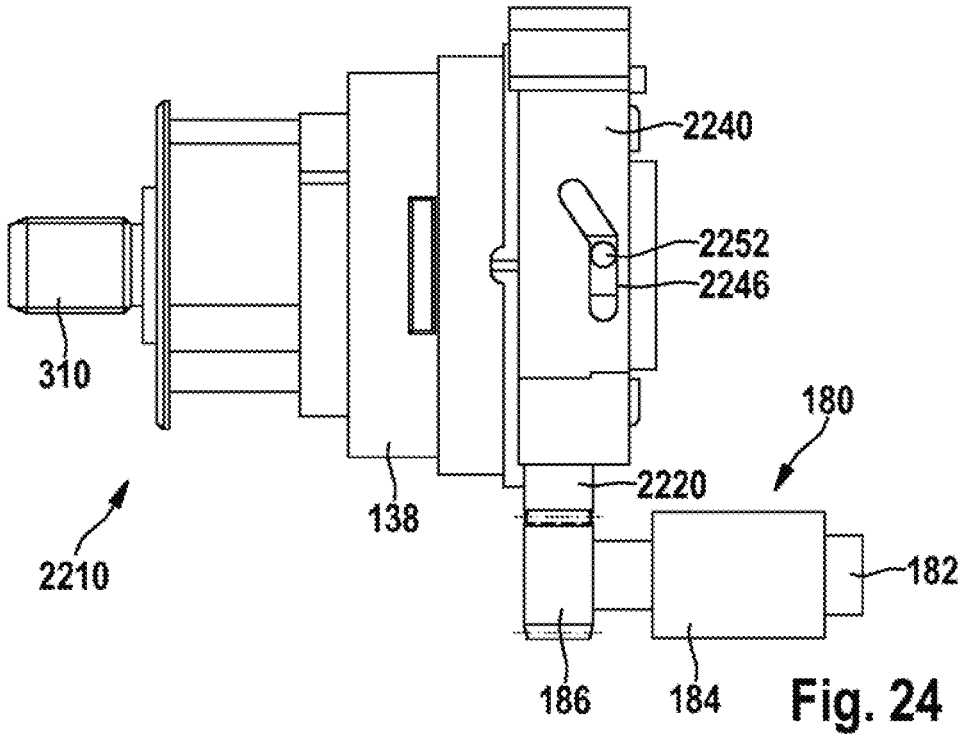
FIG. 24 shows a side view of the gear switching unit of FIG. 22 and FIG. 23, in a second gear ratio.

FIG. 24 shows the gear switching unit 2210 of FIG. 23 in the exemplary second gear ratio, or the second operating mode, respectively. The activatable shifting ring 2240, for illustrative purposes, herein is disposed so as to be rotated in comparison with FIG. 23.

Figure 25:
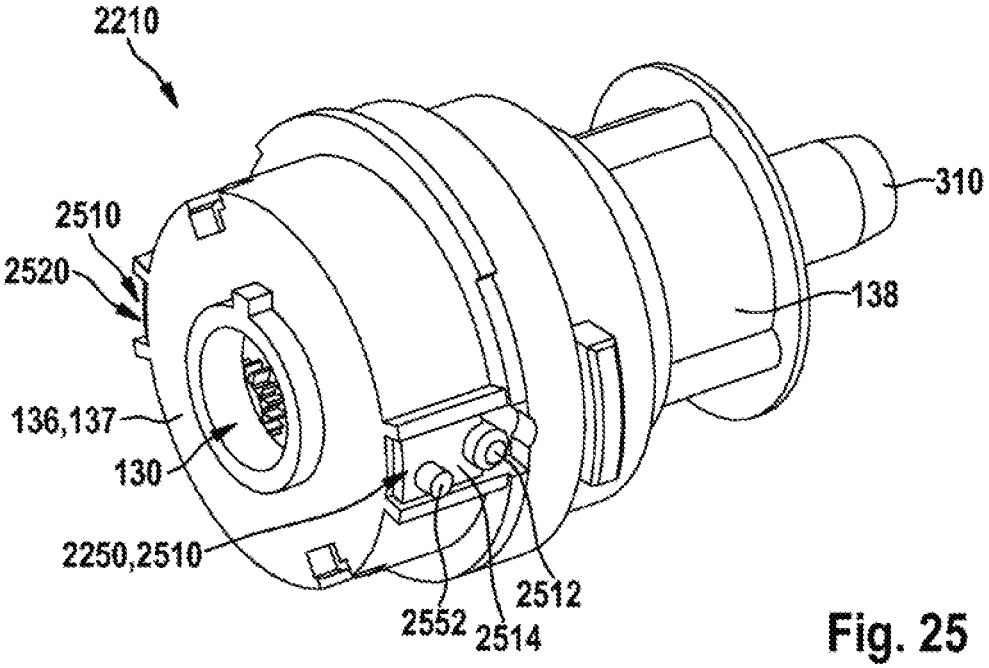
FIG. 25 shows a perspective side view of the gear switching unit of FIG. 22 to FIG. 24.

FIG. 25 shows the gear switching unit 2210 of FIG. 22 to FIG. 24, without the activatable is shifting ring 2240, and highlights the for illustrative purposes pin-type guide element 2252. The guide element 2252 is preferably connected to the shifting rod 2250 by way of a connection element 2512. The guide element 2252 and the connection element 2512 herein are disposed on a for illustrative purposes plate-type main body 2514.

The connection element 2512 at least in portions preferably shrouds an end of an arcuate main body (2610 in FIG. 26) that is assigned to the shifting rod 2250. For illustrative purposes, the guide element 2252 and the connection element 2512 are disposed so as to be mutually spaced apart in the axial direction of the gearbox 130 of FIG. 2; however, the guide element 2252 can be connected to the connection element 2512 in any arbitrary other direction, for example be disposed in the radial direction on the connection element 2512.

The plate-like main body 2514, the guide element 2252, and the connection element 2512 preferably configure a guide unit 2510 which is preferably disposed in a receptacle 2520 of the gearbox housing 136, in particular of the first gearbox housing part 137 of FIG. 2. The shifting rod 2250 preferably has two guide units 2510 which are preferably disposed so as to be diametrically opposite.

Figure 26:
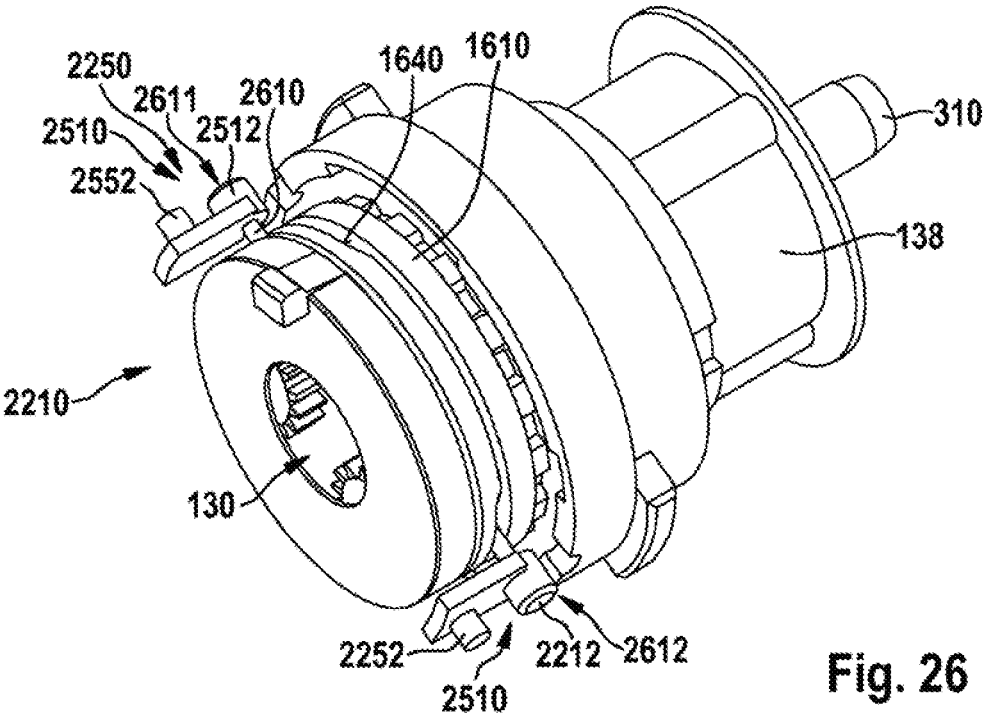
FIG. 26 shows a perspective view of the gear switching unit of FIG. 22 to FIG. 25, without the gearbox housing.

FIG. 26 shows the gear switching unit 2210 of FIG. 25, without the first gearbox housing part 137 of FIG. 2, having the shifting annulus 1610 of FIGS. 16 and 17, having the clearance 1640 for disposing the shifting rod 2250. For illustrative purposes, the shifting rod 2250 has an arcuate main body 2610 having a first and a second end 2611, 2612. The arcuate main body 2610 is preferably configured in the manner of a wire bracket, could however, in a manner analogous to that of FIG. 16 and FIG. 17, also have a rectangular cross-section, or alternatively thereto also be configured as a piece of wire. In each case one guide unit 2510 is preferably disposed on the two ends 2611, 2612 of the main body 2610. FIG. 26 herein highlights the disposal of the connection element 2512 of the guide unit 2510 on an end of the arcuate main body 2610, wherein the respective end 2611, 2612 is at least in portions, preferably completely, shrouded by the connection element 2512.

The invention claimed is:

1. A hand-held power tool comprising:

a drive unit having at least one drive motor configured to drive an insert tool and a gearbox coupled to the at least one drive motor, the gearbox configured to switch between at least two different gear ratios; and a communications interface configured to communicate with a user guide unit configured to be activated by a user, the communications interface configured to receive from the user guide unit switching instructions for switching the gearbox in an application-specific manner between the two different gear ratios, wherein:

the communications interface is configured to transmit a control signal to at least one operating element enabling the at least one operating element to generate a command to initiate the switching procedure that switches the gearbox between the two different gear ratios upon activation by the user.

2. The hand-held power tool as claimed in claim 1, wherein the user guide unit is at least one of (i) at least in part integrated in the hand-held power tool and (ii) at least in part configured as an external, separate component.

3. The hand-held power tool as claimed in claim 1, wherein the user guide unit has a mobile computer.

4. The hand-held power tool as claimed in claim 3, wherein the mobile computer is one of a smart phone and a tablet computer.

5. The hand-held power tool as claimed in claim 1, wherein the user guide unit has an interactive program.

6. The hand-held power tool as claimed in claim 5, wherein the interactive program is a smart phone app.

7. The hand-held power tool as claimed in claim 1, wherein:

the at least one operating element has an illumination device; and the control signal is configured to activate the illumination device to visualize the command to be generated upon activation of the at least one operating element by the user.

8. The hand-held power tool as claimed in claim 7, wherein:

the at least one operating element includes a plurality of operating elements; and the control signal is configured to illuminate only a selected one of the plurality of operating elements.

9. The hand-held power tool of claim 8, wherein the selected one of the plurality of operating elements is selected based upon a predefined operation.

10. The hand-held power tool as claimed in claim 1, wherein the at least one operating element is configured as one of a switch and a push-button.

11. The hand-held power tool as claimed in claim 1, wherein:

the at least one operating element has a display; and the control signal is configured to generate an indication on the display to visualize the command to be generated upon activation of the at least one operating element by the user.

12. The hand-held power tool as claimed in claim 11, wherein the display is configured as a touchscreen.

13. The hand-held power tool as claimed in claim 1, wherein:

the at least one operating element has a sensor configured to transmit an activation signal to the communications interface in response to the at least one operating element being activated.

14. The hand-held power tool as claimed in claim 1 further comprising:

a servomotor configured to switch the gearbox between the two different gear ratios in response to the at least one operating element gearbox being activated.

15. The hand-held power tool as claimed in claim 14, wherein the communications interface is configured to transmit a control signal configured to activate the servomotor to the servomotor.

16. The hand-held power tool as claimed in claim 1, wherein:

the communications interface is configured to transmit a control signal to actuators of the hand-held power tool; and at least one actuator of the actuators is configured to, when activated by the communications interface, switch the gearbox between the two different gear ratios.

17. The hand-held power tool as claimed in claim 1, wherein the communications interface is configured as a wireless transmission module.

18. The hand-held power tool as claimed in claim 17, wherein the wireless transmission module is a radio module configured to communicate wireless using a Bluetooth standard.

* * * * *